US007665318B2

(12) United States Patent
Jung et al.

(10) Patent No.: US 7,665,318 B2
(45) Date of Patent: Feb. 23, 2010

(54) COMPRESSOR CONTROLLING APPARATUS AND METHOD

(75) Inventors: Gyoo Ha Jung, Suwon-Si (KR); Myung Seob Song, Suwon-Si (KR); Jong Kweon Ha, Suwon-Si (KR); Kaneko Takashi, Osaka (JP); Kusaka Michiyoshi, Osaka (JP)

(73) Assignee: Samsung Electronics Co., Ltd., Suwon-Si (KR)

( * ) Notice: Subject to any disclaimer, the term of this patent is extended or adjusted under 35 U.S.C. 154(b) by 612 days.

(21) Appl. No.: 11/094,781

(22) Filed: Mar. 31, 2005

(65) Prior Publication Data

US 2005/0252223 A1 Nov. 17, 2005

(30) Foreign Application Priority Data

May 17, 2004 (KR) ..... 10-2004-0034901

(51) Int. Cl.
*F25B 49/00* (2006.01)

(52) U.S. Cl. ..... 62/175; 62/196.2; 62/196.3; 62/228.3; 62/510

(58) Field of Classification Search ..... 62/175, 62/196.1, 196.2, 196.3, 228.1, 228.3, 510; 317/301, 309; 361/22
See application file for complete search history.

(56) References Cited

U.S. PATENT DOCUMENTS 2,875,592 A * 3/1959 Olsen ..... 62/192
3,377,816 A * 4/1968 Berger ..... 62/157
RE29,621 E * 5/1978 Conley et al. ..... 62/196.2
4,324,105 A * 4/1982 Cann ..... 62/196.2
4,790,142 A * 12/1988 Beckey ..... 62/115
5,062,274 A * 11/1991 Shaw ..... 62/117
5,524,448 A 6/1996 Schwanebeck et al.
5,577,390 A * 11/1996 Kaido et al. ..... 62/228.5
5,732,564 A * 3/1998 Misawa et al. ..... 62/218
6,085,533 A * 7/2000 Kaido et al. ..... 62/196.2
6,142,740 A * 11/2000 Connell ..... 417/2
6,233,954 B1 * 5/2001 Mehaffey et al. ..... 62/175
6,453,691 B1 * 9/2002 Seo et al. ..... 62/228.5

(Continued)

FOREIGN PATENT DOCUMENTS

JP 02097846 A * 4/1990

(Continued)

OTHER PUBLICATIONS

Chinese Patent Office Action, mailed Aug. 17, 2007 and issued in corresponding Chinese Patent Application No. 2005100028686.

(Continued)

*Primary Examiner*—Marc E Norman
(74) *Attorney, Agent, or Firm*—Staas & Halsey LLP

(57) ABSTRACT

A compressor controlling apparatus including a bypass unit connected between an outlet and an inlet of the compressor and a control unit. The control unit reduces pressure difference between the outlet and the inlet of the compressor by the bypass unit to start the compressor when the compressor is to be started. The compressor is started while pressure equilibrium is achieved by the bypass unit, thereby preventing poor start-up of the compressor caused due to excessive pressure difference, and thus improving reliability of the compressor.

22 Claims, 24 Drawing Sheets

U.S. PATENT DOCUMENTS

| | | | | |
|---|---|---|---|---|
| 6,612,121 | B2 * | 9/2003 | Moon et al. | 62/175 |
| 6,735,965 | B2 * | 5/2004 | Moon et al. | 62/175 |
| 7,124,595 | B2 * | 10/2006 | Park et al. | 62/199 |
| 2003/0010047 | A1 * | 1/2003 | Shimoda | 62/228.3 |
| 2005/0044866 | A1 * | 3/2005 | Shaw et al. | 62/160 |
| 2005/0162787 | A1 * | 7/2005 | Weigel | 361/22 |
| 2005/0252223 | A1 * | 11/2005 | Jung et al. | 62/175 |
| 2006/0053811 | A1 * | 3/2006 | Lifson et al. | 62/196.3 |
| 2006/0117773 | A1 * | 6/2006 | Street et al. | 62/213 |
| 2007/0151454 | A1 * | 7/2007 | Marwitz et al. | 96/7 |

FOREIGN PATENT DOCUMENTS

| | | |
|---|---|---|
| JP | 10-205895 | 8/1998 |

OTHER PUBLICATIONS

English Abstract of JP 2002-364938.

* cited by examiner

FIG. 2C

Start-up success : O
Start-up failure : X

| Number of compressor start-ups | | | | | | |
|---|---|---|---|---|---|---|
| Pressure difference ($P_H$-$P_L$) [kgf/cm²] | First time | Second time | Third time | Fourth time | Fifth time | Sixth time |
| 3.5 | X | X | X | X | X | X |
| 3.0 | X | X | X | X | X | X |
| 2.5 | X | O | X | X | O | X |
| 2.0 | X | X | O | X | X | O |
| 1.5 | O | O | O | O | O | O |
| 1.0 | O | O | O | O | O | O |

COMPRESSOR CONTROLLING APPARATUS AND METHOD

CROSS-REFERENCE TO RELATED APPLICATION

This application claims the benefit of Korean Patent Application No. 2004-34901, filed on May 17, 2004 in the Korean Intellectual Property Office, the disclosure of which is incorporated herein by reference.

BACKGROUND OF THE INVENTION

1. Field of the Invention

The present invention relates to a compressor controlling apparatus and method, and, more particularly, to a compressor controlling apparatus and method that is capable of starting a compressor while pressure equilibrium is achieved.

2. Description of the Related Art

A compressor is mounted in an air conditioner or a refrigerator, as a part of a refrigerating cycle, to compress an operating fluid introduced into the compressor and to discharge the compressed operating fluid.

FIG. 1*a* shows the construction of an air conditioner with a conventional singular compressor mounted therein. An outlet pipe 3 of a compressor 1 is connected to an outdoor heat exchanger 10 via a four-way valve 9. The outdoor heat exchanger 10 is connected to an expansion unit 11 via a coolant pipe, and the expansion unit 11 is also connected to an indoor heat exchanger 12 via another coolant pipe. An outlet of the indoor heat exchanger 12 is connected to an inlet of the compressor 1 via an accumulator 13 and a low-pressure pipe 8. In this way, a closed circuit is formed in the air conditioner.

In the past, a state in which pressure equilibrium is reached has not been considered. This has been true not only when the compressor 1 is initially operated but also when the compressor 1 is operated again after the operation of the compressor 1 is stopped. As a result, a pressure difference between the outlet and the inlet of the compressor is large when the compressor is started. As a result, overload may be caused, which leads to poor start-up of the compressor.

FIG. 1*b* shows the construction of an air conditioner with conventional plural compressors mounted therein. Outlet pipes 3 and 4 of compressors 1 and 2 are commonly connected to a high-pressure pipe 7, which is connected to an outdoor heat exchanger 10 via a four-way valve 9. The outdoor heat exchanger 10 is connected to an expansion unit 11 via a coolant pipe, and the expansion unit 11 is also connected to an indoor heat exchanger 12 via another coolant pipe. An outlet of the indoor heat exchanger 12 is connected to inlets of the compressors 1 and 2 via an accumulator 13 and a low-pressure pipe 8. In this way, a closed circuit is formed in the air conditioner.

When an operational load is small and where plural compressors are mounted in an air conditioner, one of the compressors is operated while the other compressors is/are not operated. As the operational load is increased during the operation of the compressor, the non-operated compressor(s) is/are operated as necessary.

To this end, the high-pressure pipe is commonly connected to the outlet pipes of these plural compressors. Consequently, when only one of the compressors is operated, high-pressure coolant gas that is discharged from the operated compressor may be introduced into the non-operated compressor. To prevent damage from this phenomenon, reverse-flow preventing check valves 5 and 6 are provided at the outlets of the plural compressors, as shown in FIG. 1*b*.

However, the presence of the check valves 5 and 6 do not completely prevent the introduction of the high-pressure coolant gas into the non-operated compressor. As a result, some of the coolant gas is introduced into the non-operated compressor through the corresponding check valve. When the non-operated compressor is started while the coolant gas is held in the non-operated compressor, the pressure at the outlet of the non-operated compressor is higher than usual. Thus, the pressure inside the non-operated compressor is also high. As a result, an outlet valve, which serves to supply compressed coolant to the outlet pipe, is not opened when the non-operated compressor is started. Consequently, the compressor is poorly started, and reliability of the compressor is deteriorated.

SUMMARY OF THE INVENTION

Therefore, an aspect of the invention provides a compressor controlling apparatus and method capable of starting a non-operated compressor while pressure equilibrium is achieved to prevent poor start-up of the compressor caused due to excessive pressure difference between an outlet and an inlet of the compressor so as to reliability of the compressor.

In accordance with one aspect of the invention, the present invention provides a compressor controlling apparatus, comprising: a compressor; a bypass unit connected between an outlet and an inlet of the compressor; and a control unit to reduce a pressure difference between the outlet and the inlet of the compressor via the bypass unit to start the compressor when the compressor is to be started.

In accordance with another aspect of the invention, the present invention provides a compressor controlling apparatus, comprising: a compressor; a bypass unit connected between an outlet and an inlet of the compressor; a pressure equilibrium determining unit to determine whether a pressure equilibrium between the inlet and the outlet of the compressor is achieved; and a control unit to reduce a pressure difference between the outlet and the inlet of the compressor via the bypass unit to start the compressor if the pressure equilibrium determining unit determines that the pressure equilibrium is not achieved when the compressor is to be started.

In accordance with another aspect of the invention, the present invention provides a compressor controlling apparatus, comprising: plural compressors connected to each other in parallel; a bypass unit connected between an outlet and an inlet of at least one of the compressors; and a control unit to reduce a pressure difference between the outlet and the inlet of the non-operated compressor via the bypass unit to start the non-operated compressor when the non-operated compressor is to be started.

In accordance with another aspect of the invention, the present invention provides a compressor controlling apparatus, comprising: plural compressors connected to each other in parallel; a bypass unit connected between an outlet and an inlet of at least one of the compressors; a pressure equilibrium determining unit to determine whether a pressure equilibrium between the inlet and the outlet of the compressor with the bypass unit mounted thereto is achieved; and a control unit to reduce a pressure difference between the outlet and the inlet of the compressor via the bypass unit to start the non-operated compressor if the pressure equilibrium determining unit determines that the pressure equilibrium is not achieved when the non-operated compressor is to be started.

In accordance with another aspect of the invention, the present invention provides a compressor controlling method of a compressor having a bypass unit connected between an outlet and an inlet of the compressor and a control unit, wherein the method comprises: determining whether the compressor is to be started; reducing a pressure difference between the outlet and inlet of the compressor via the bypass unit to achieve a pressure equilibrium when the compressor is to be started; and starting the compressor while the pressure equilibrium is achieved.

In accordance with another aspect of the invention, the present invention provides a compressor controlling method of a compressor having a bypass unit connected between an outlet and an inlet of the compressor, a pressure equilibrium determining unit to determine whether pressure equilibrium between the inlet and the outlet of the compressor is achieved, and a control unit, wherein the method comprises: determining whether the compressor is to be started; determining whether the pressure equilibrium is achieved for the compressor via the pressure equilibrium determining unit when the compressor is to be started; reducing a pressure difference between the outlet and inlet of the compressor via the bypass unit to achieve pressure equilibrium when the pressure equilibrium between the inlet and the outlet of the compressor is determined to not have been achieved; and starting the compressor while the pressure equilibrium is achieved.

In accordance with yet another aspect of the invention, the present invention provides a compressor controlling method of plural compressors having a bypass unit connected between an outlet and an inlet of at least one of the compressors and a control unit, wherein the method comprises: determining whether the compressors are to be started; initially starting the compressor with no bypass unit mounted thereto when the compressors are to be started; reducing a pressure difference between the outlet and inlet of the compressor with the bypass unit mounted thereto via the bypass unit to achieve pressure equilibrium when the compressor with the bypass unit mounted thereto is to be started; and starting the compressor with the bypass unit mounted thereto while the pressure equilibrium is achieved.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which:

FIG. 2*c* is a table showing results of start-up tests of a non-operated compressor on the basis of a pressure difference;

DETAILED DESCRIPTION OF THE PREFERRED EMBODIMENTS

Figure 1A:
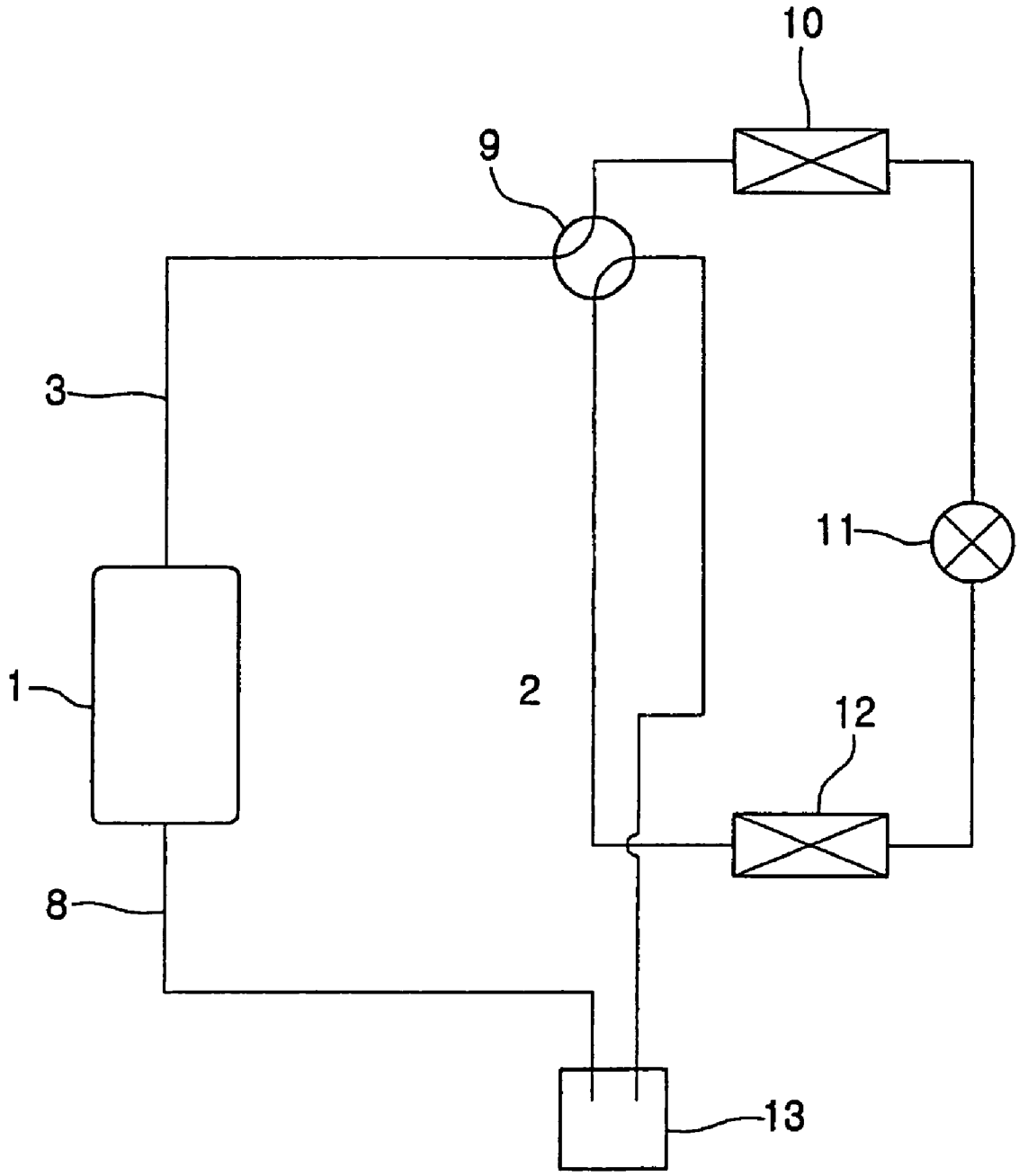
FIGS. 1*a* and 1*b* are views respectively showing the construction of an air conditioner with a conventional compressor(s) mounted therein.
Figure 1B:
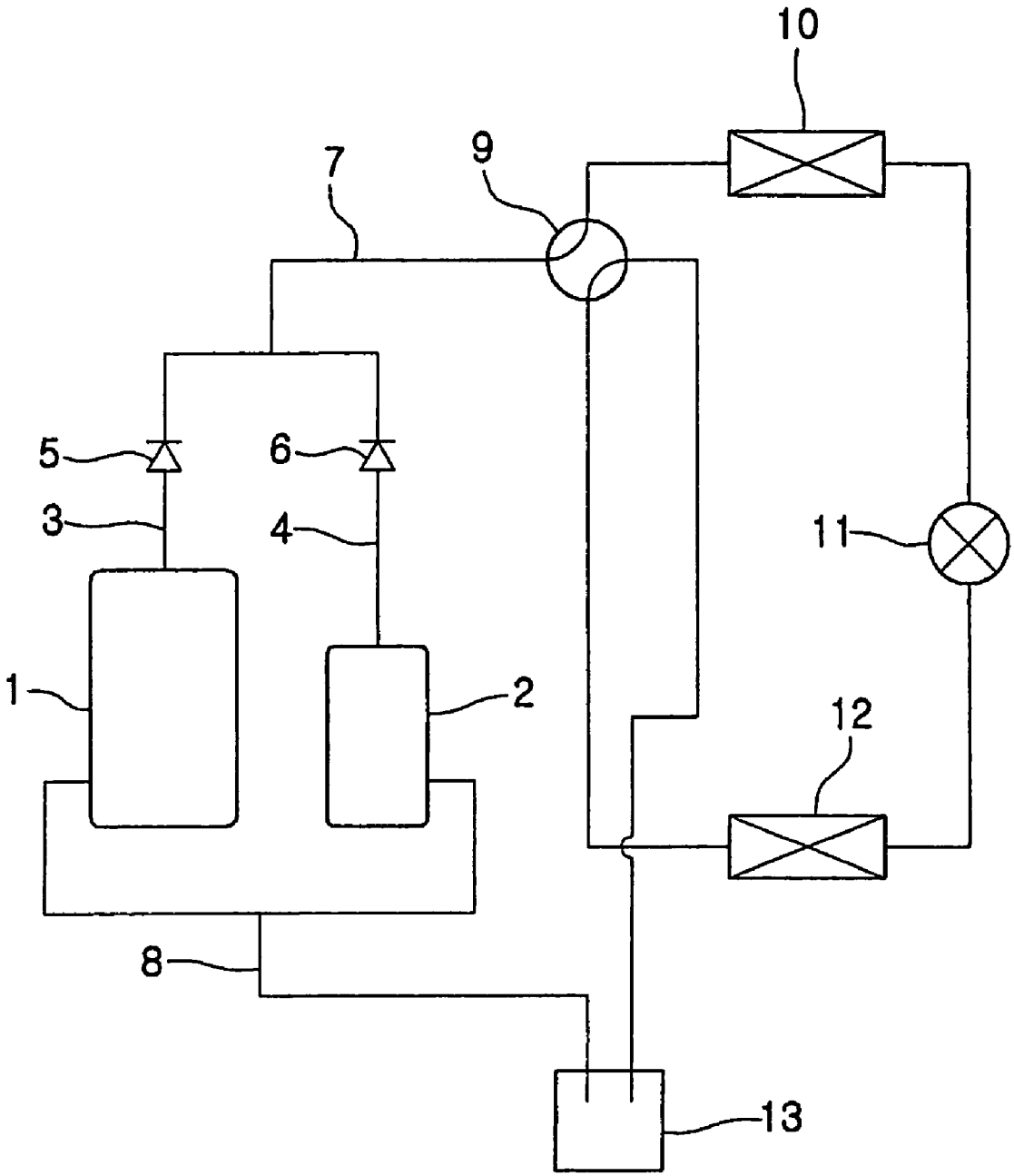

Reference will now be made in detail to the embodiments of the present invention, examples of which are illustrated in the accompanying drawings, wherein like reference numerals refer to the like elements throughout. The embodiments are described below to explain the present invention by referring to the figures.

First to fifth embodiments of the present invention are all applied to an air conditioner. However, the present invention is not restricted to the air conditioner. For example, the present invention may be applied to a refrigerator with a compressor mounted therein.

Figure 2A:
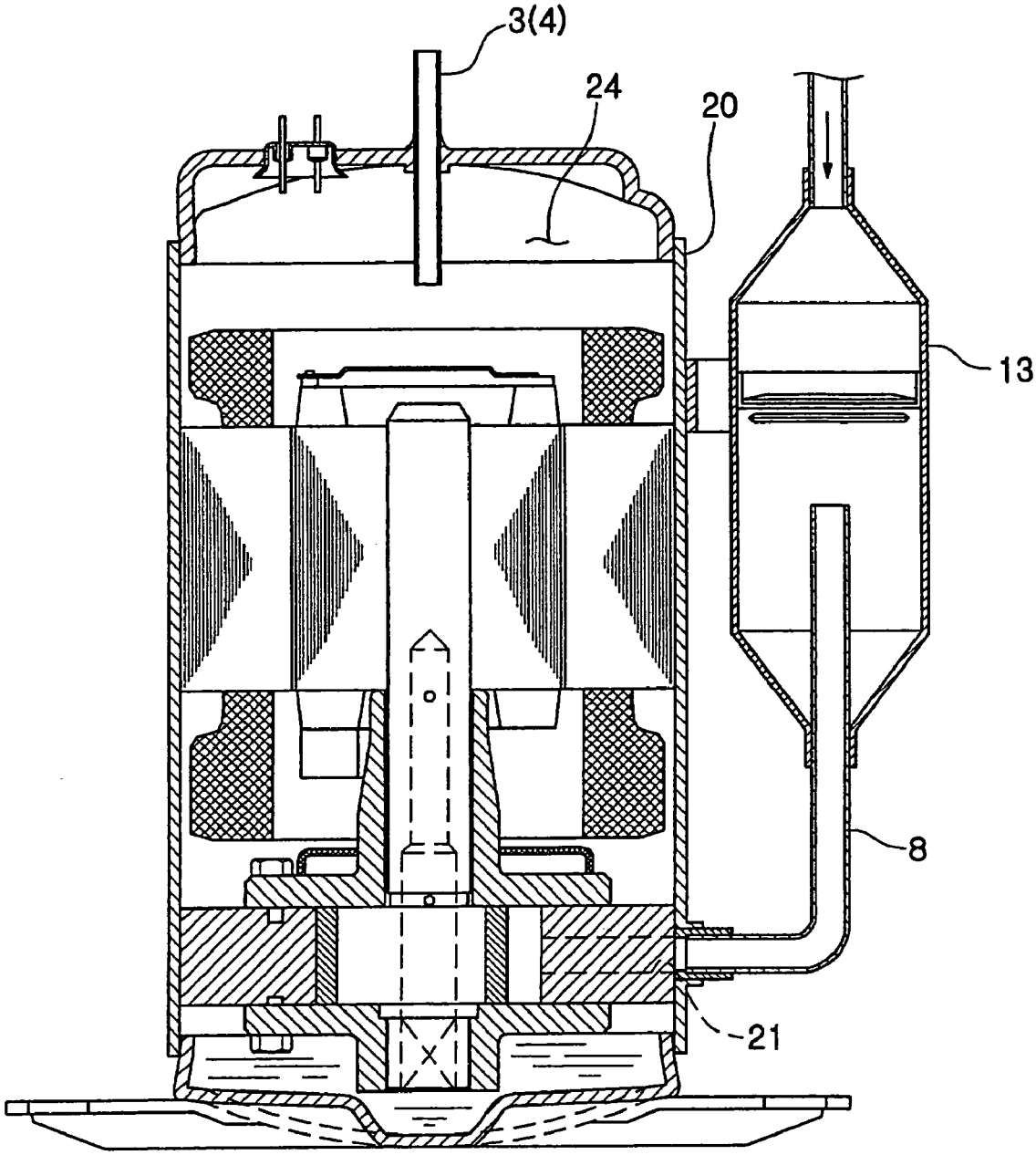
FIGS. 2*a* and 2*b* are views respectively showing the structure of a compressor to which the present invention is applied.

A compressor 20 to which the present invention is applied includes an inlet 21 connected to one end of a low-pressure pipe 8 to allow low-pressure coolant from an accumulator 13 to be introduced into the compressor 20 therethrough, as shown in FIG. 2*a*.

Figure 2B:
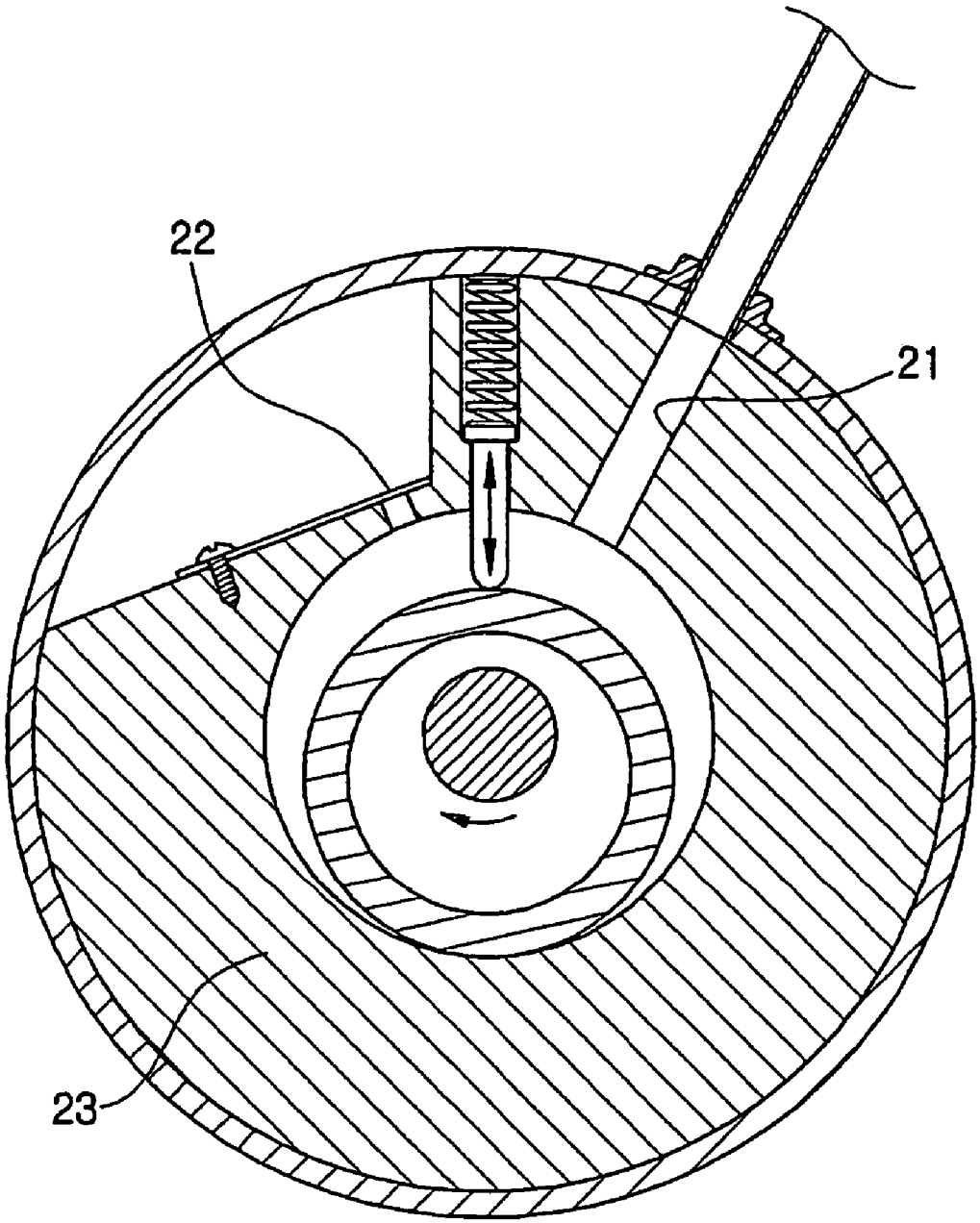

As shown in FIG. 2*b*, the coolant introduced through the inlet 21 is compressed and expanded in a cylinder 23, and is then discharged from the cylinder 23. The high-pressure coolant is guided into a discharging chamber 24 formed at the upper part of the compressor 20, and is then discharged from the discharging chamber 24 through an outlet 3, 4, one end of which extends downward into the discharging chamber 24.

Start-up tests of the compressor based on a pressure difference have been performed, results of which are shown in FIG. 2*c*. It can be seen from FIG. 2*c* that the compressor has been smoothly started when the pressure difference between the outlet and the inlet of the compressor is not more than 1.5 $kgf/cm^2$.

Figure 3A:
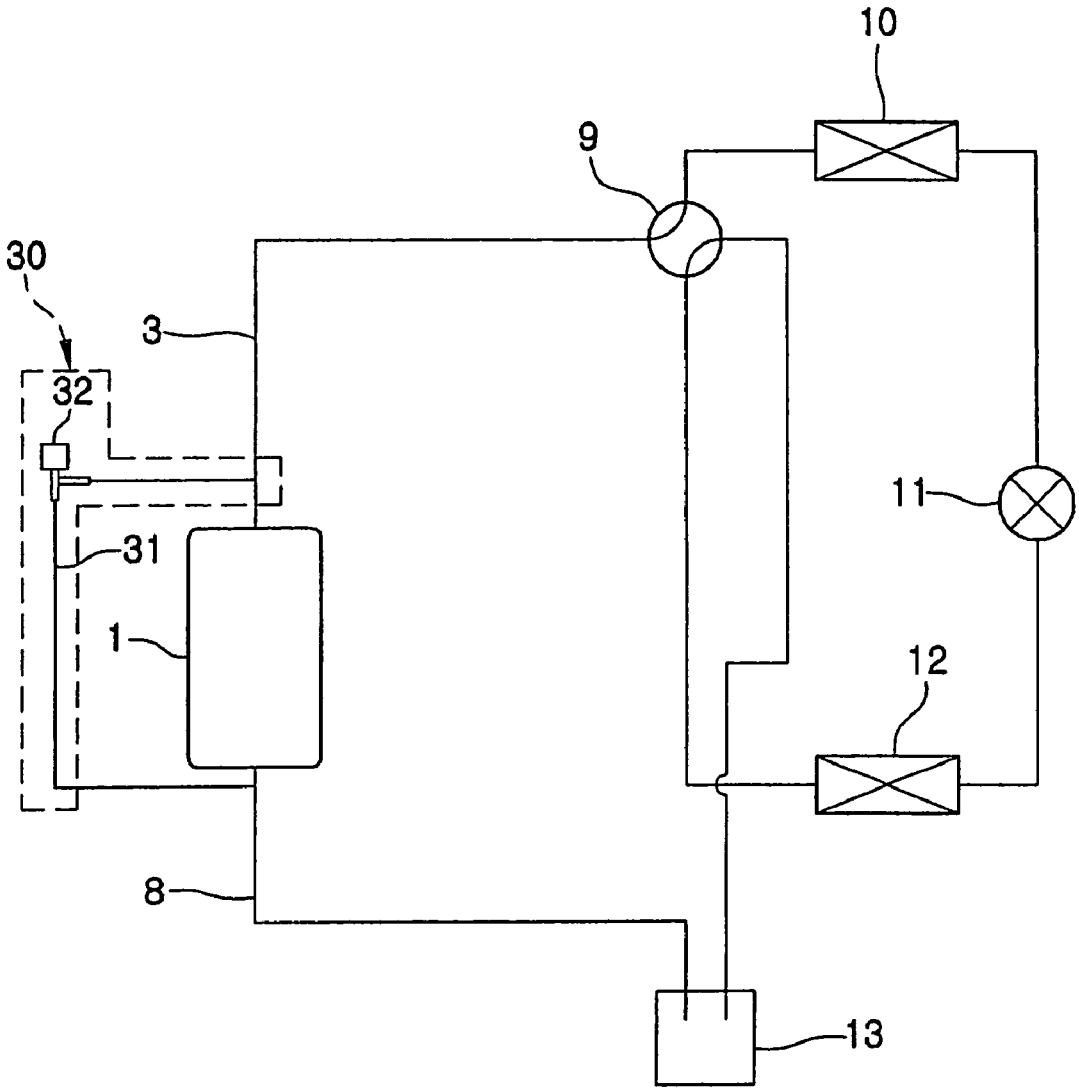
FIG. 3*a* is a view of a compressor controlling apparatus according to a first embodiment of the present invention showing a bypass unit applied to a singular compressor.

FIG. 3*a* is a view of a compressor controlling apparatus according to a first embodiment of the present invention showing a bypass unit applied to a singular compressor.

A compressor 1, an outdoor heat exchanger 10, an expansion unit 11, an indoor heat exchanger 12, and an accumulator 13 are connected to each other via coolant pipes so as to form a closed circuit. An outlet pipe 3 of the compressor 1 is connected to a four-way valve 9. A first bypass unit 30, which is also connected to the inlet of the compressor 1, is connected to the compressor 1.

The first bypass unit 30 has a first bypass valve 32 on a first bypass line 31 that is connected between the outlet and the inlet of the compressor 1.

Figure 3B:
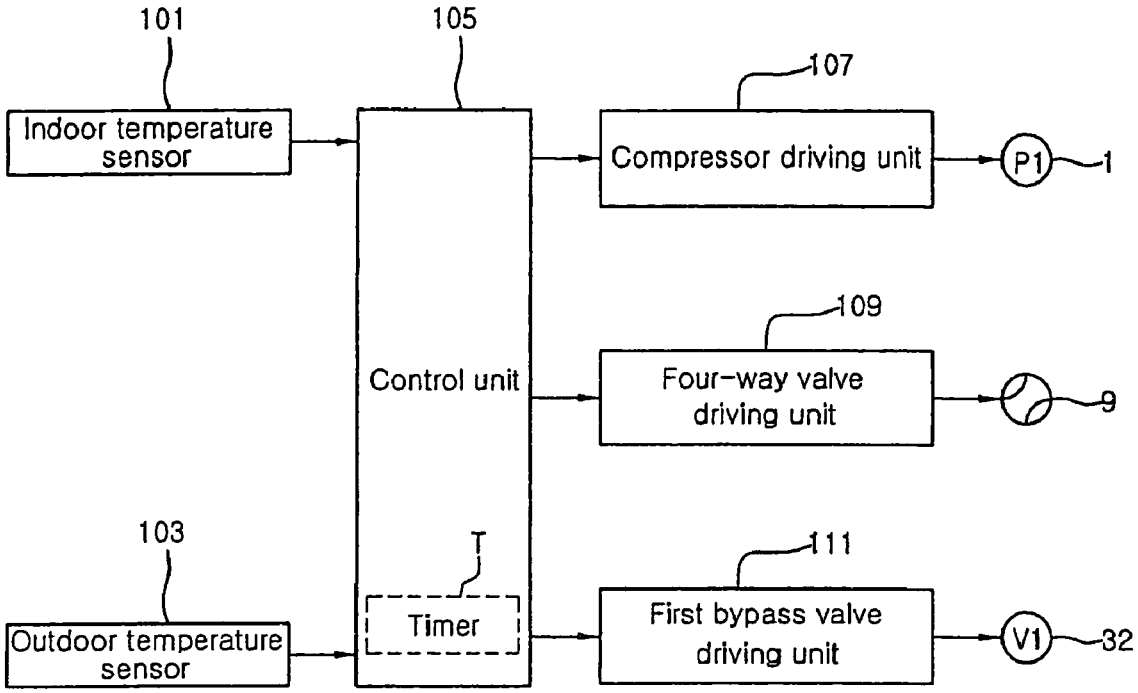
FIG. 3*b* is a control block diagram of FIG. 3*a;*

FIG. 3*b* is a control block diagram of FIG. 3*a*. As shown in FIG. 3*b*, a first bypass valve driving unit 111 opens/closes the first bypass valve 32 according to control of a control unit 105.

Figure 3C:
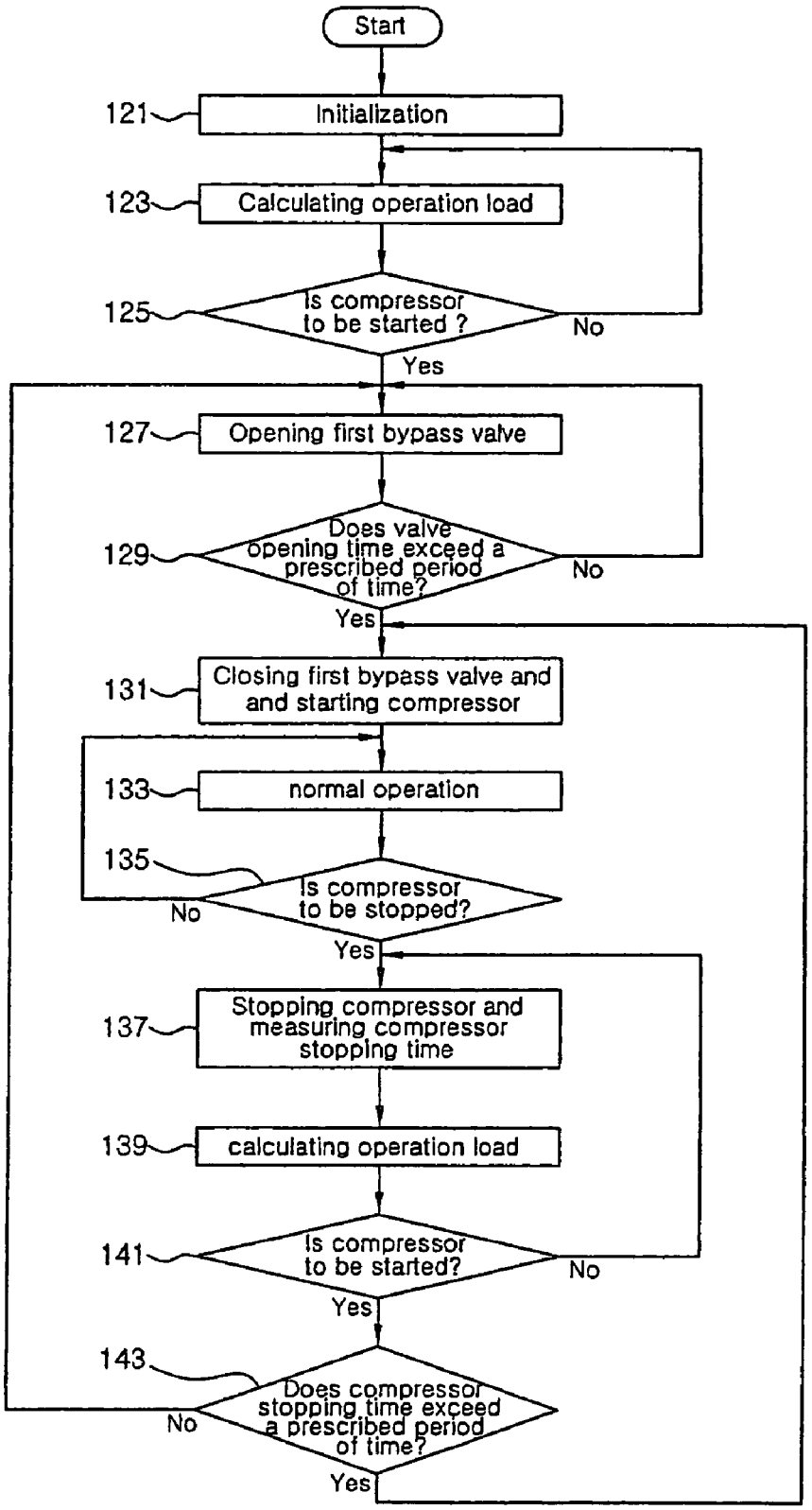
FIG. 3*c* is a flow chart showing a compressor controlling method according to a first embodiment of the present invention.

FIG. 3*c* is a flow chart showing a compressor controlling method according to the first embodiment of the present invention. As shown in FIG. 3*c*, the control unit 105 initializes the air conditioner, calculates operation load using an indoor temperature sensor 101 and an outdoor temperature sensor 103, and determines whether the compressor is to be started (121, 123 and 125).

When the compressor to which the compressor controlling method according to the first embodiment of the invention is applied is to be started, the control unit 105 opens the first bypass valve 32 for a prescribed period of time so that pressure difference between the outlet and the inlet of the compressor is reduced (127 and 129). The time required to open the bypass valve is set to more than the minimum time necessary to achieve a state in which a pressure equilibrium is reached between inlet and outlet pressures of the compressor within a normal operation range.

As the pressure difference is reduced by virtue of opening the first bypass valve as described above, the control unit 105 closes the first bypass valve 32, and then starts the compressor 1 (131).

At this point, whether the operation of the compressor is to be stopped during the normal operation of the compressor (133 and 135) is determined. When the operation of the compressor is to be stopped, the control unit 105 stops the operation of the compressor via a timer T, measures a compressor stopping time, and determines whether the non-operated compressor is to be started on the basis of the calculated operational load (137, 139 and 141).

When the compressor is to be started, the control unit 105 determines whether the measured compressor stopping time exceeds a prescribed period of time. When the measured compressor stopping time is determined to exceed the prescribed period of time, i.e., when a pressure equilibrium is determined to have been achieved, the procedure is returned to operation 131 so that the compressor may be started. When the measured compressor stopping time is determined to not exceed the prescribed period of time, on the other hand, the control unit 105 opens the first bypass valve, and the procedure is returned to operation 127 (143).

In the first embodiment of the present invention as described above, the compressor stopping time is measured to determine whether the pressure equilibrium is achieved, although starting the compressor after the bypass valve is opened constantly for a prescribed period of time without determining whether the pressure equilibrium is achieved may be possible. As will be described below, determining whether the pressure equilibrium is achieved by directly sensing the pressure difference using inlet and outlet pressure sensors is also possible.

Figure 4A:
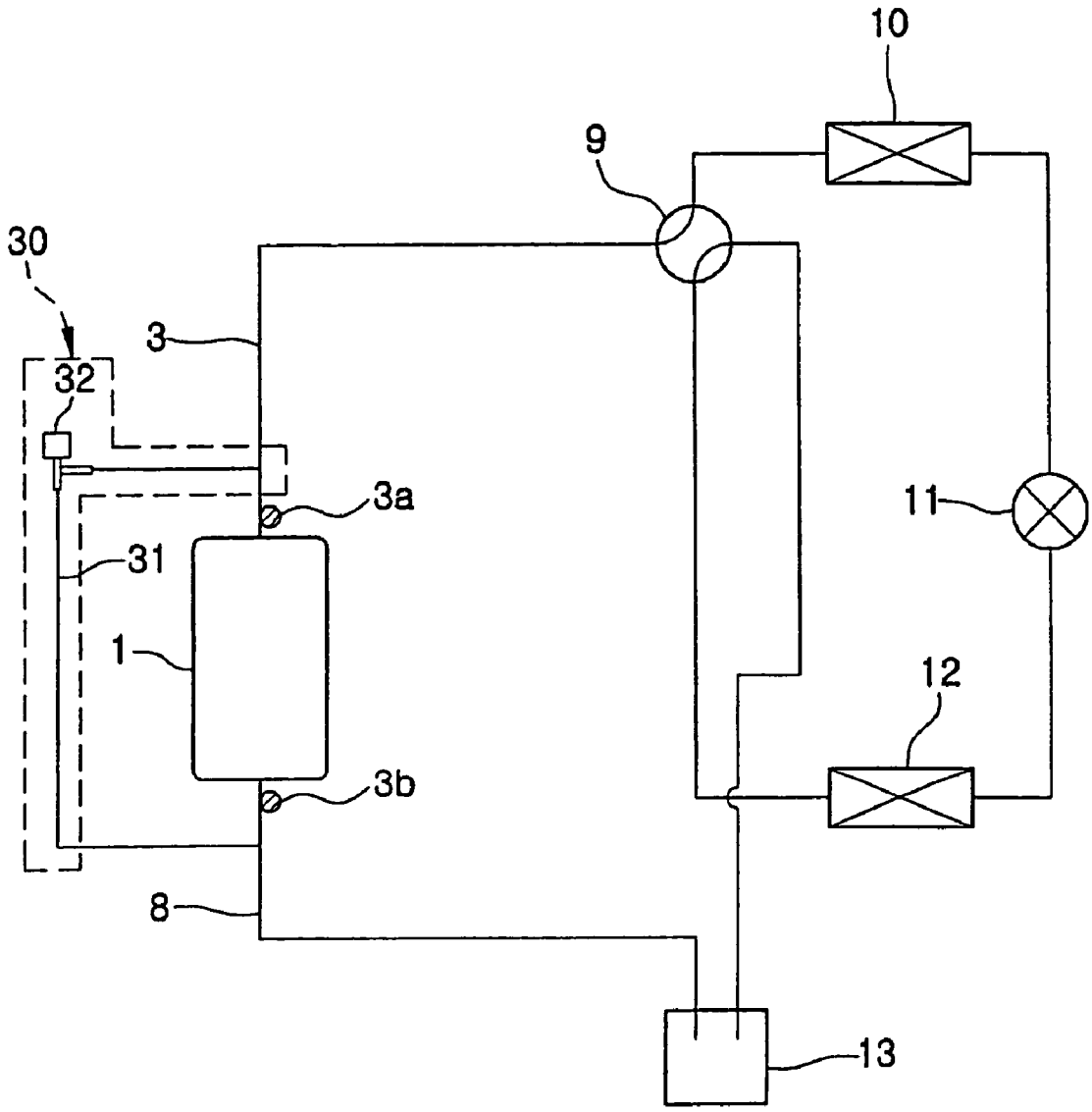
FIG. 4*a* is a view of a compressor controlling apparatus according to a second embodiment of the present invention showing a bypass unit and pressure sensors applied to a singular compressor.
Figure 4B:
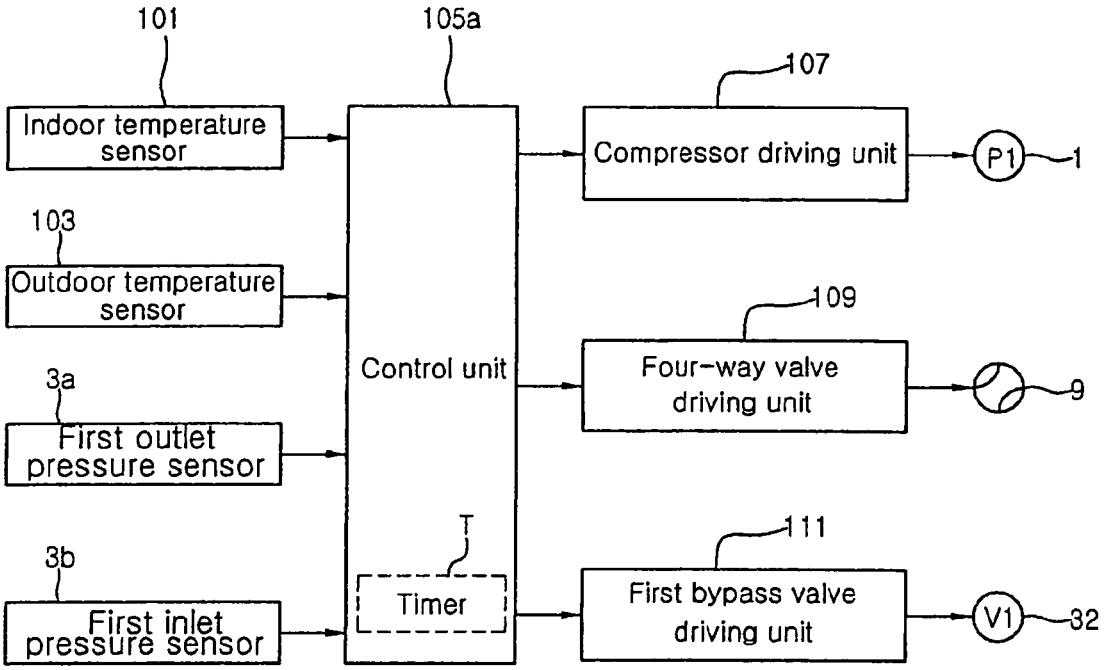
FIG. 4*b* is a control block diagram of FIG. 4*a;*

FIG. 4*a* is a view of a compressor controlling apparatus according to a second embodiment of the present invention showing a first bypass unit 30 and pressure sensors 3*a* and 3*b* that are applied to a singular compressor. The pressure sensors are mounted to the outlet and the inlet of the compressor to provide signals that are representative of outlet and inlet pressures to a control unit 105*a* (See FIG. 4*b*). The control unit 105 determines whether the pressure equilibrium is achieved based on the signal from the pressure sensors.

The first bypass unit 30 has a first bypass valve 32 on a first bypass line 31 that is connected between the outlet and the inlet of the compressor 1. A first bypass valve driving unit 111 opens/closes the first bypass valve 32 according to control of the control unit 105*a* (See FIG. 4*b*).

The control unit 105*a* determines whether the pressure equilibrium is achieved through the use of the pressure sensors before the compressor is started, and performs operations that are necessary to reduce the pressure difference through the use of the bypass unit according to the determination.

Figure 4C:
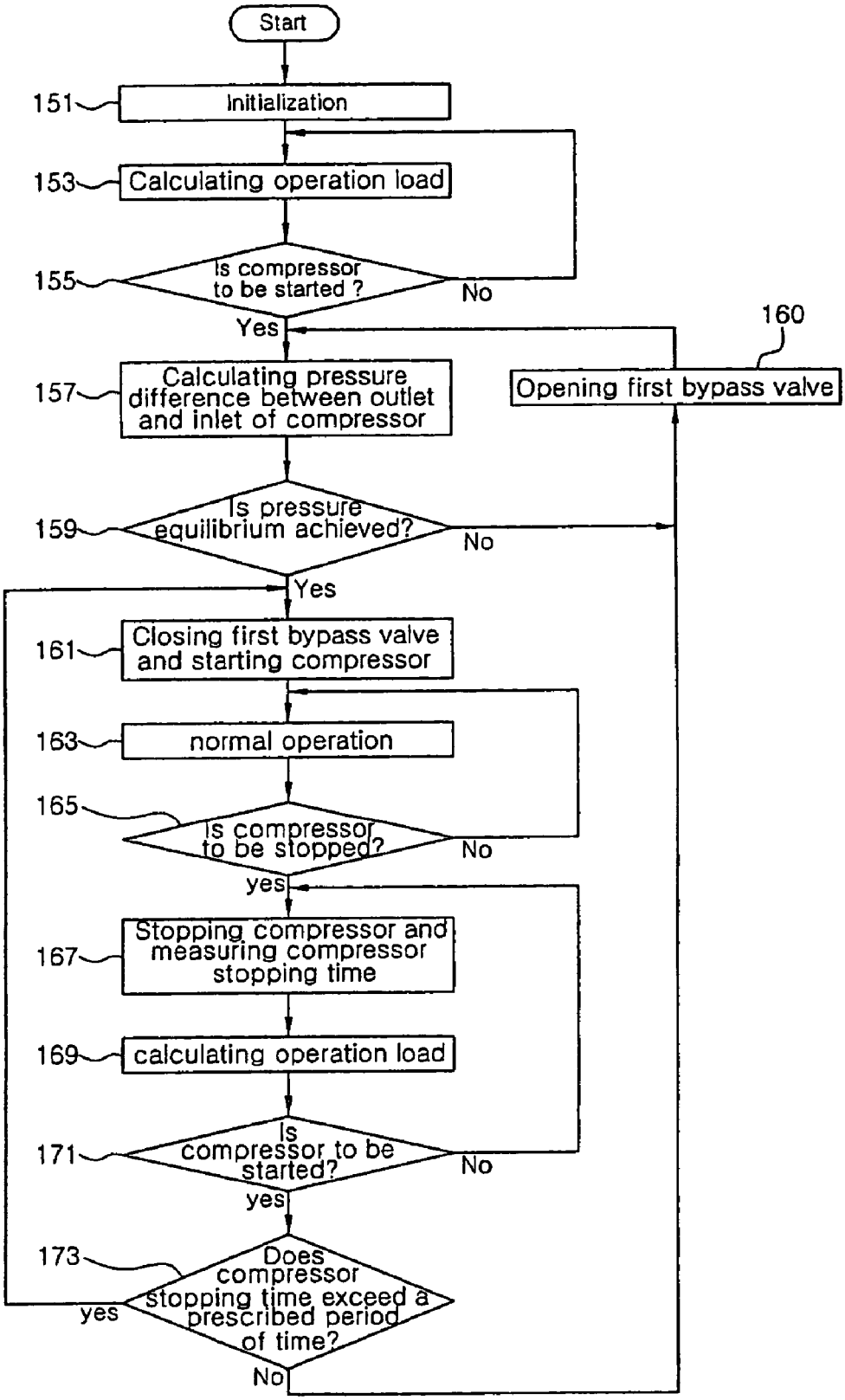
FIG. 4*c* is a flow chart showing a compressor controlling method according to a second embodiment of the present invention.

FIG. 4*c* is a flow chart showing a compressor controlling method according to a second embodiment of the present invention. As shown in FIG. 4*c*, the control unit 105*a* initializes the air conditioner, and determines whether the compressor is to be started on the basis of calculated operation load (151, 153 and 155).

When the compressor to which the compressor controlling method according to the second embodiment of the invention is applied is to be started, the control unit 105*a* calculates the pressure difference between the outlet and the inlet of the compressor through the use of the first outlet pressure sensor 3*a* and the first inlet pressure sensor 3*b*, and compares the calculated pressure difference to a prescribed value to determine whether the pressure equilibrium is achieved (157 and 159). When the pressure equilibrium is determined to not have been achieved, the control unit 105*a* opens the first bypass valve 32 (160).

When the pressure equilibrium is determined to have been achieved, the control unit 105*a* closes the first bypass valve 32, and then starts the compressor (161).

Whether the operation of the compressor is to be stopped during the normal operation of the compressor (163 and 165) is then determined. When the operation of the compressor is to be stopped, the control unit 105*a* stops the operation of the compressor via a timer T, measures compressor stopping time, and determines whether the non-operated compressor is to be started based on calculated operational load (167, 169 and 171). When the compressor is to be started, the control unit 105*a* determines whether the measured compressor stopping time exceeds a prescribed period of time. When the measured compressor stopping time is determined to exceed the prescribed period of time, the procedure is returned to operation 161. When the measured compressor stopping time is determined to not exceed the prescribed period of time, on the other hand, the procedure is returned to operation 160 (173).

In the second embodiment of the present invention as described above, the compressor stopping time is measured to determine whether the pressure equilibrium is achieved, although starting the compressor after the bypass valve is opened constantly for a prescribed period of time without determining whether the pressure equilibrium is achieved may be possible. Determining whether the pressure equilibrium is achieved by directly sensing the pressure difference using inlet and outlet pressure sensors may also be possible.

Figure 5A:
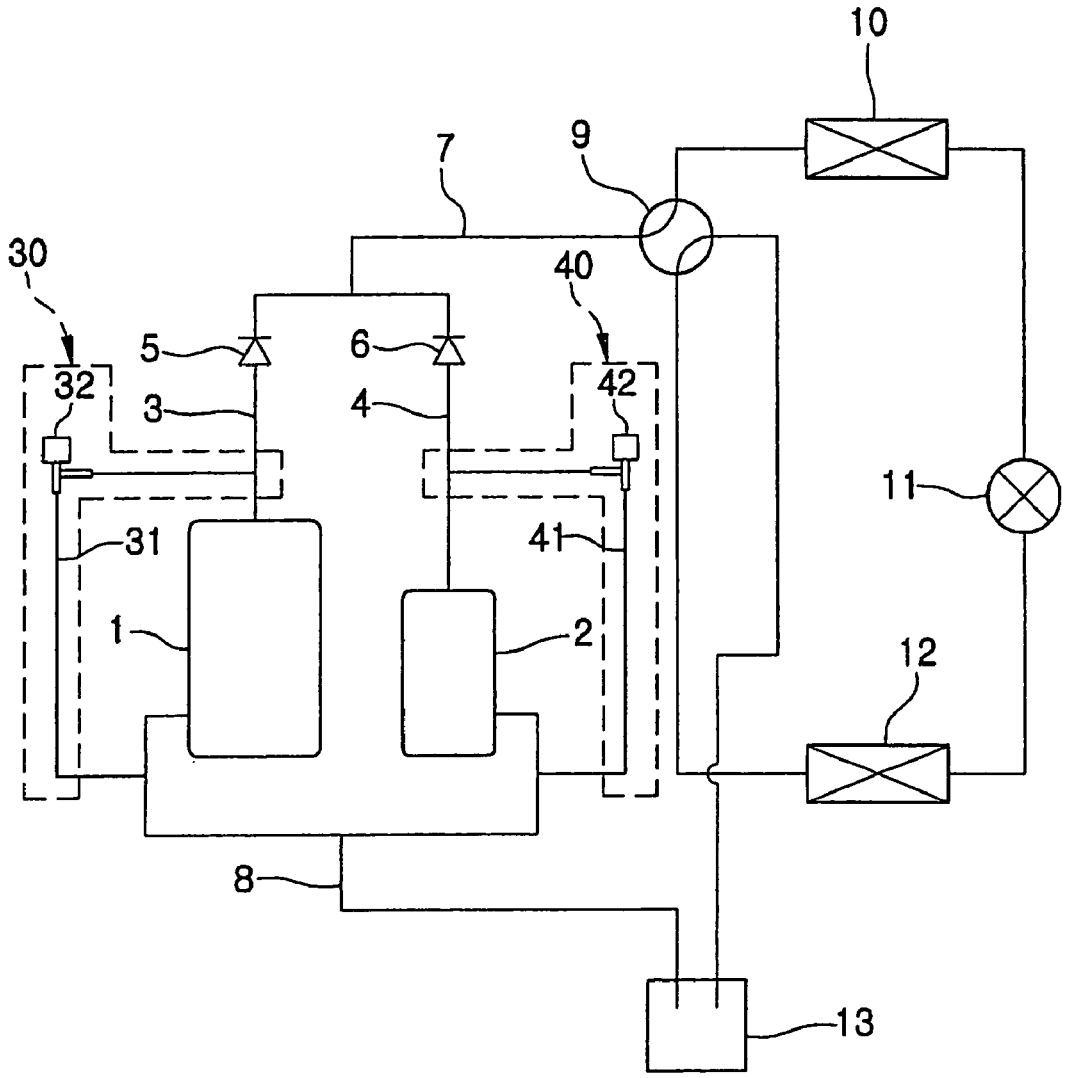
FIG. 5*a* is a view of a compressor controlling apparatus according to a third embodiment of the present invention showing bypass units applied to plural compressors.

FIG. 5*a* is a view of a compressor controlling apparatus according to a third embodiment of the present invention showing bypass units applied to plural compressors. In this embodiment, the plural compressors include a large-capacity compressor 1 and a small-capacity compressor 1 connected to the large-capacity compressor 1 in parallel, although the plural compressors have the same capacity.

As shown in FIG. 5*a*, outlet pipes 3 and 4 of the plural compressors 1 and 2 are commonly connected to a high-pressure pipe 7. Reverse-flow preventing check valves 5 and 6 are mounted on the outlet pipes 3 and 4, respectively.

The compressor controlling apparatus according to the third embodiment of the present invention includes a first bypass unit 30 that is connected between the outlet and the inlet of the compressor 1 and a second bypass unit 40 that is connected between the outlet and the inlet of the compressor 2.

The first bypass unit 30 has a first bypass valve 32 on a first bypass line 31 connected between the outlet and the inlet of the large-capacity compressor 1. Similarly, the second bypass unit 40 has a second bypass valve 42 on a second bypass line 41 connected between the outlet and the inlet of the small-capacity compressor 1.

Figure 5B:
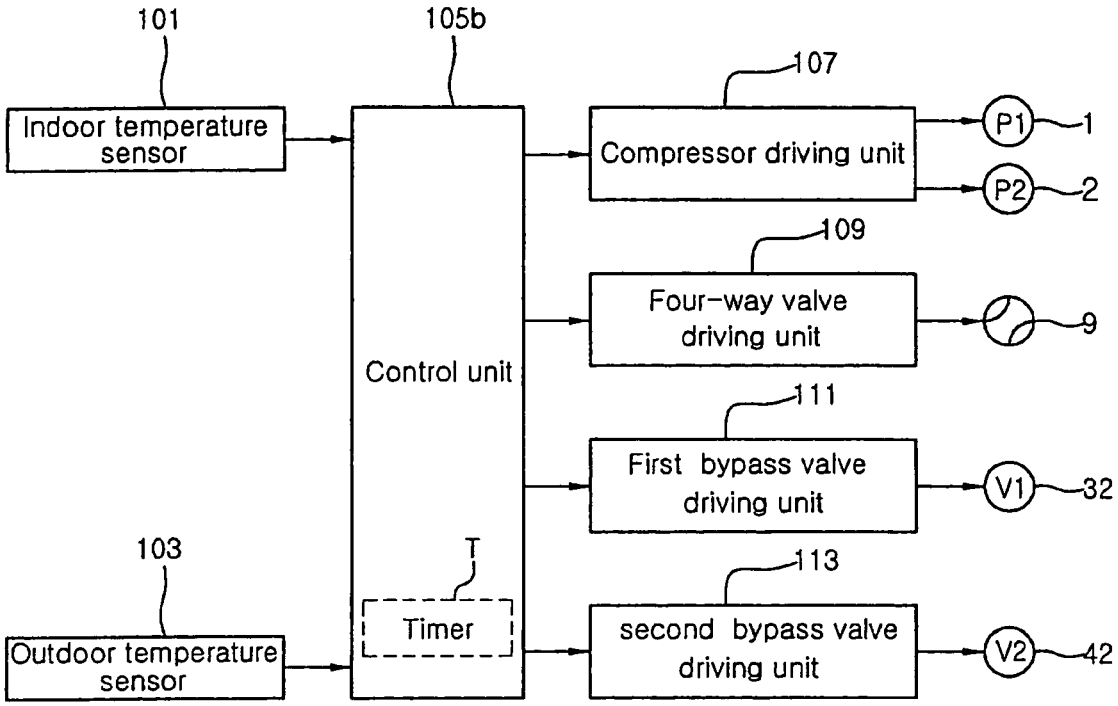
FIG. 5*b* is a control block diagram of FIG. 5*a;*

The first and second bypass valves 32 and 42 are opened/closed according to control of a control unit 105*b* (See FIG. 5*b*).

The control unit 105*b* properly controls the first and second bypass valves 32 and 42 so that a poor start-up of the plural compressor is prevented.

Figure 5C:
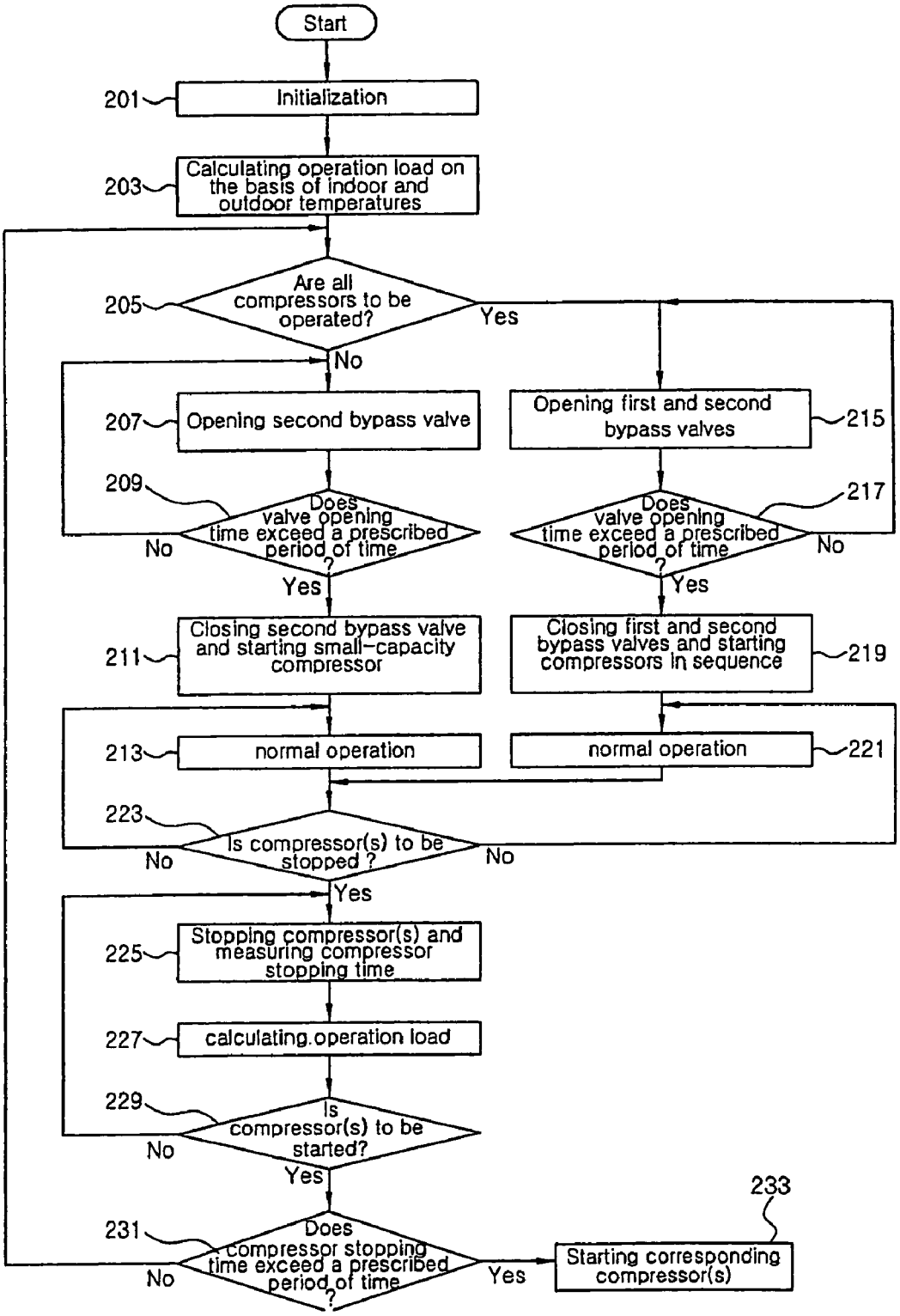
FIG. 5*c* is a flow chart showing a compressor controlling method according to a third embodiment of the present invention.

FIG. 5*c* is a flow chart showing a compressor controlling method according to a third embodiment of the present invention. As shown in FIG. 5*c*, the control unit 105*b* calculates operational load based on indoor and outdoor temperatures sensed via temperature sensors 101 and 103, and determines whether all the plural compressors are to be operated according to the calculated operational load (201, 203 and 205). When not all the plural compressors are to be operated, the control unit 105*b* opens the second bypass valve 42 that is mounted to the small-capacity compressor 2 (207), measures valve opening time via an inner timer, and determines whether the measured valve opening time exceeds a prescribed period of time (209). When the measured valve opening time is determined to exceed a prescribed period of time, the control unit 105*b* closes the second bypass valve 42, and starts the small-capacity compressor 2 (211). Thereafter, the compressor is normally operated (213).

When all the plural compressors are to be operated at operation 205, the control unit 105*b* opens the first and second bypass valves 32 and 42 (215), and determines whether the valve opening time measured via the inner timer exceeds the prescribed period of time (217). When the measured valve opening time is determined to exceed the prescribed period of time, the control unit 105*b* closes the first and second bypass valves 32 and 42, and starts the plural compressors in sequence (219). Thereafter, the compressors are normally operated (221).

Whether the operation of the compressors is to be stopped during the normal operation of the compressors (223) is then determined. When the compressors are to be stopped, the control unit 105*a* stops the operation of the compressors, measures compressor stopping time via a timer T, and determines whether the non-operated compressors are to be started on the basis of calculated operational load (225, 227 and 229). Since determining whether the pressure equilibrium is achieved when one of the plural compressors is operated while the other of the plural compressor is stopped may be difficult, the compressor stopping time is measured while all the plural compressors are stopped.

When the compressor(s) is/are to be started, the control unit 105*a* determines whether the measured compressor stopping time exceeds a prescribed period of time. When the measured compressor stopping time is determined to exceed the prescribed period of time, the procedure proceeds to operation 233 so that the corresponding compressor(s) is/are started. When the measured compressor stopping time is determined to not exceed the prescribed period of time, on the other hand, the procedure is returned to operation 205 (231).

Figure 6A:
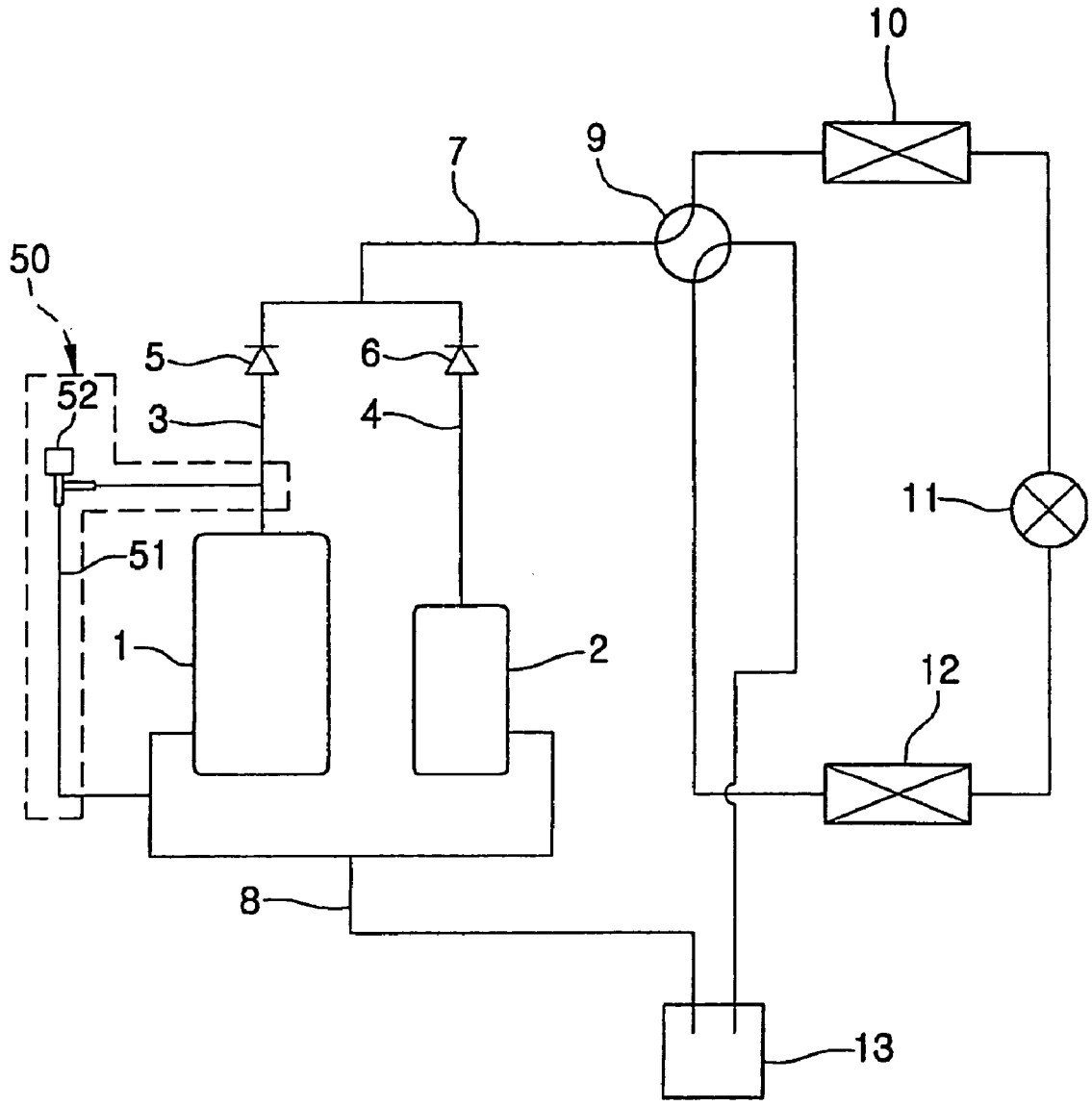
FIG. 6*a* is a view of a compressor controlling apparatus according to a fourth embodiment of the present invention showing a bypass unit applied to a large-capacity compressor, one of plural compressors.

A bypass unit may be mounted to one of the compressors 1 and 2 so that poor start-up of the compressor is prevented. FIG. 6*a* is a view of a compressor controlling apparatus according to a fourth embodiment of the present invention showing a third bypass unit 50 applied to a large-capacity compressor 1, which may represent one of at least two plural compressors, and FIG. 6*c* is a view of the compressor controlling apparatus according to a fourth embodiment of the present invention showing a fourth bypass unit 60 applied to a small-capacity compressor 2, the other of plural compressors.

Figure 6B:
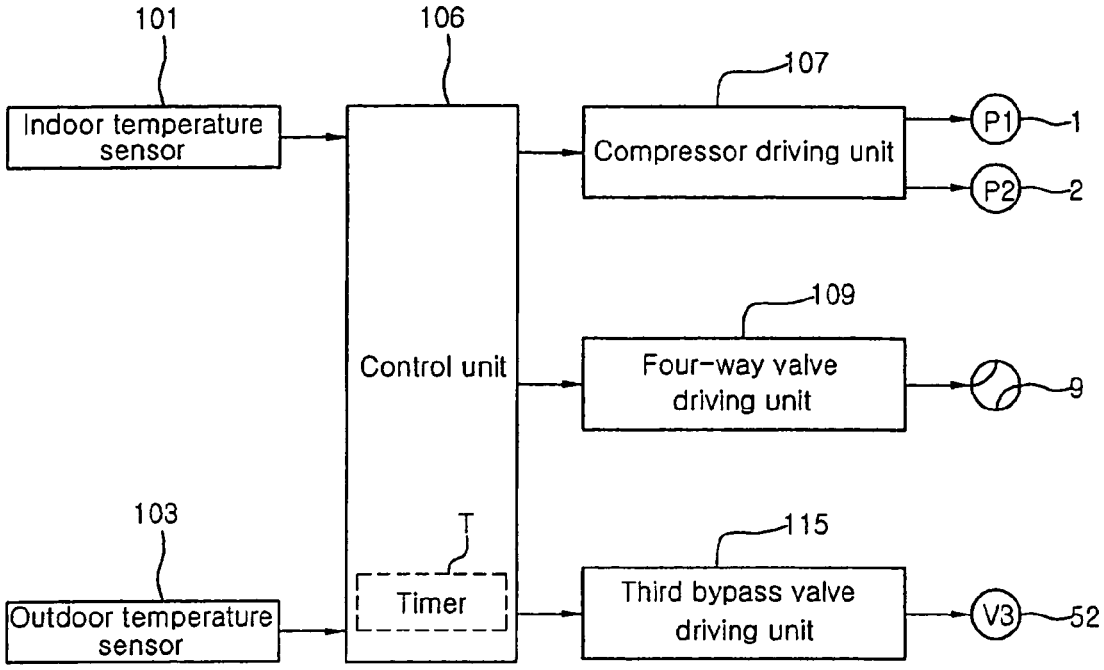
FIG. 6*b* is a control block diagram of FIG. 6*a;*

As shown in FIG. 6*a*, the third bypass unit 50 is mounted to the large-capacity compressor 1. The small-capacity compressor 2 is initially operated. As an operational load is increased, operating the large-capacity compressor 1, which is not operated, is necessary. Before the non-operated compressor 1 is started, a control unit 106 opens a third bypass valve 52 of the third bypass unit 50 so that the pressure difference between the outlet and the inlet of the compressor 1 is reduced (Also see FIG. 6*b*).

Figure 6C:
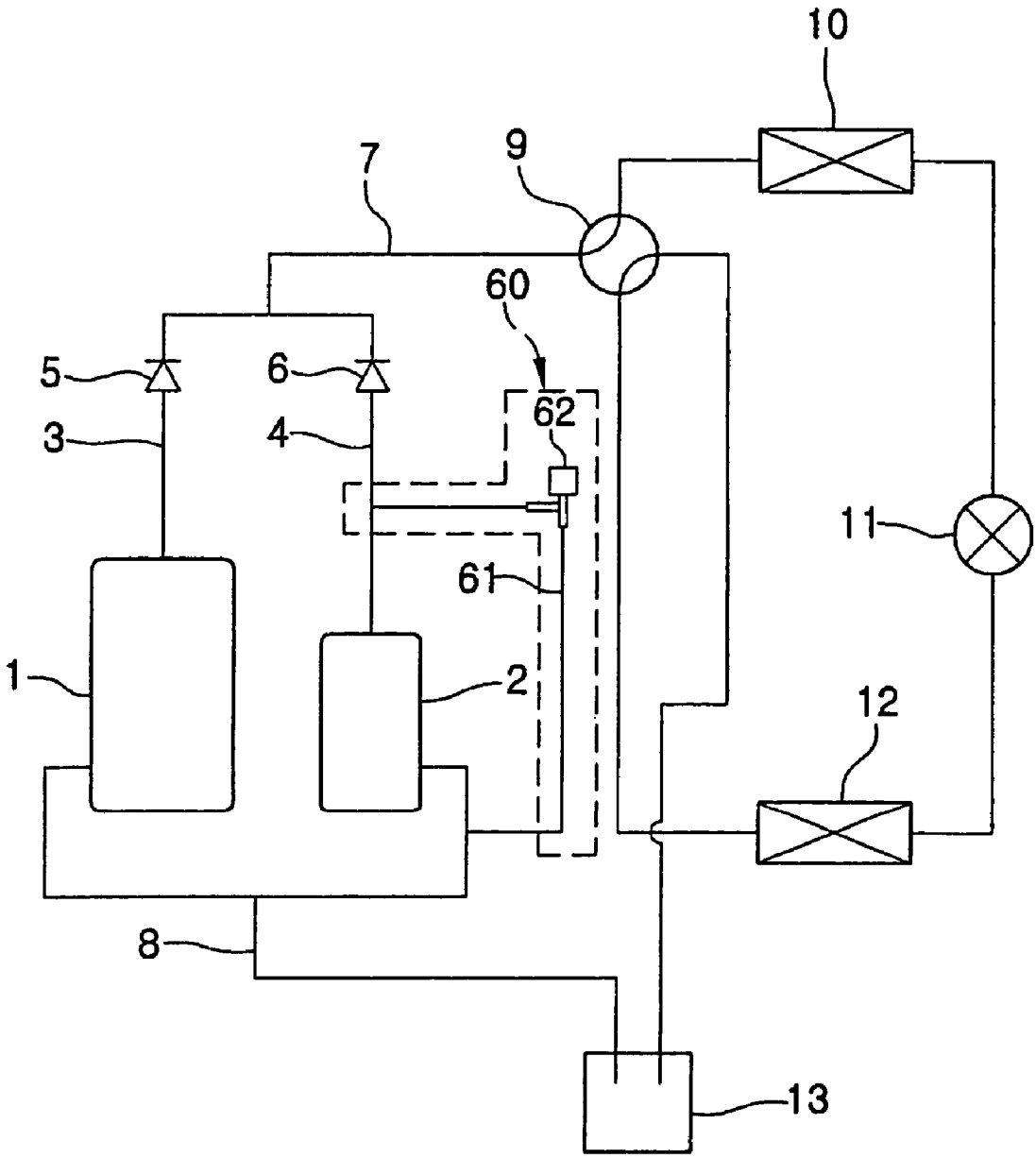
FIG. 6*c* is a view of a compressor controlling apparatus according to a fourth embodiment of the present invention showing a bypass unit applied to a small-capacity compressor, one of plural compressors.
Figure 6D:
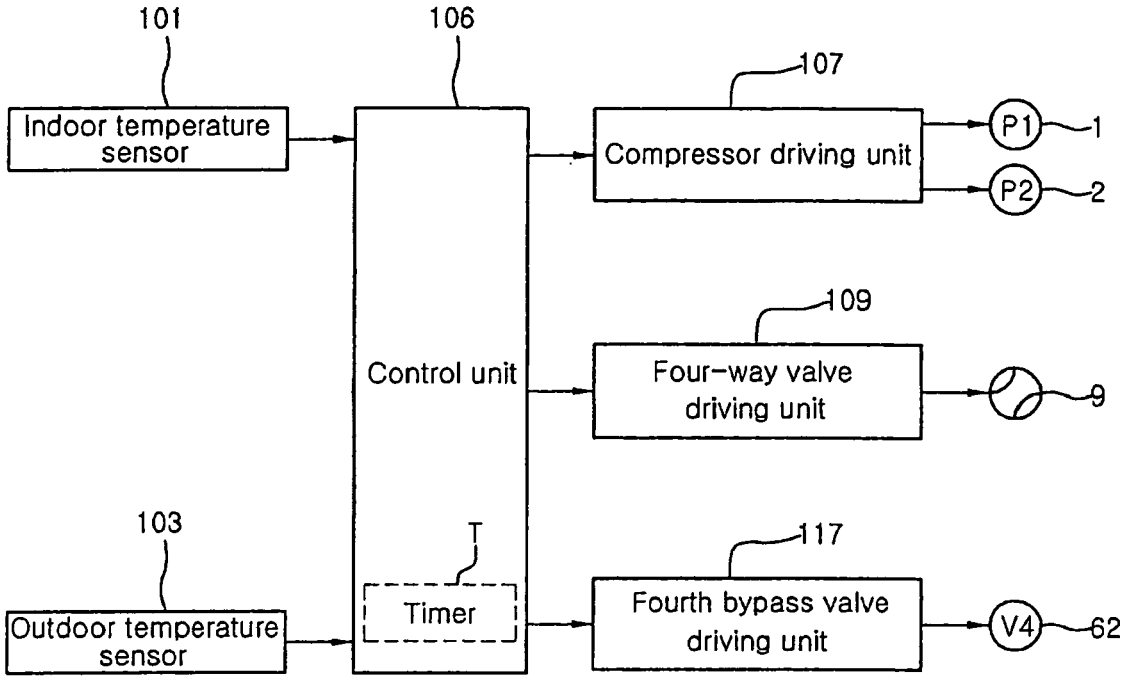
FIG. 6*d* is a control block diagram of FIG. 6*c;*

As shown in FIG. 6*c*, the fourth bypass unit 60 is mounted to the small-capacity compressor 2. The large-capacity compressor 1 is initially operated. As an operational load is increased, operating the small-capacity compressor 2, which is not operated, becomes necessary. Before the non-operated compressor 2 is started, the control unit 106 opens a fourth bypass valve 62 of the fourth bypass unit 60 so that the pressure difference between the outlet and the inlet of the compressor 2 is reduced (Also see FIG. 6*d*).

Figure 6E:
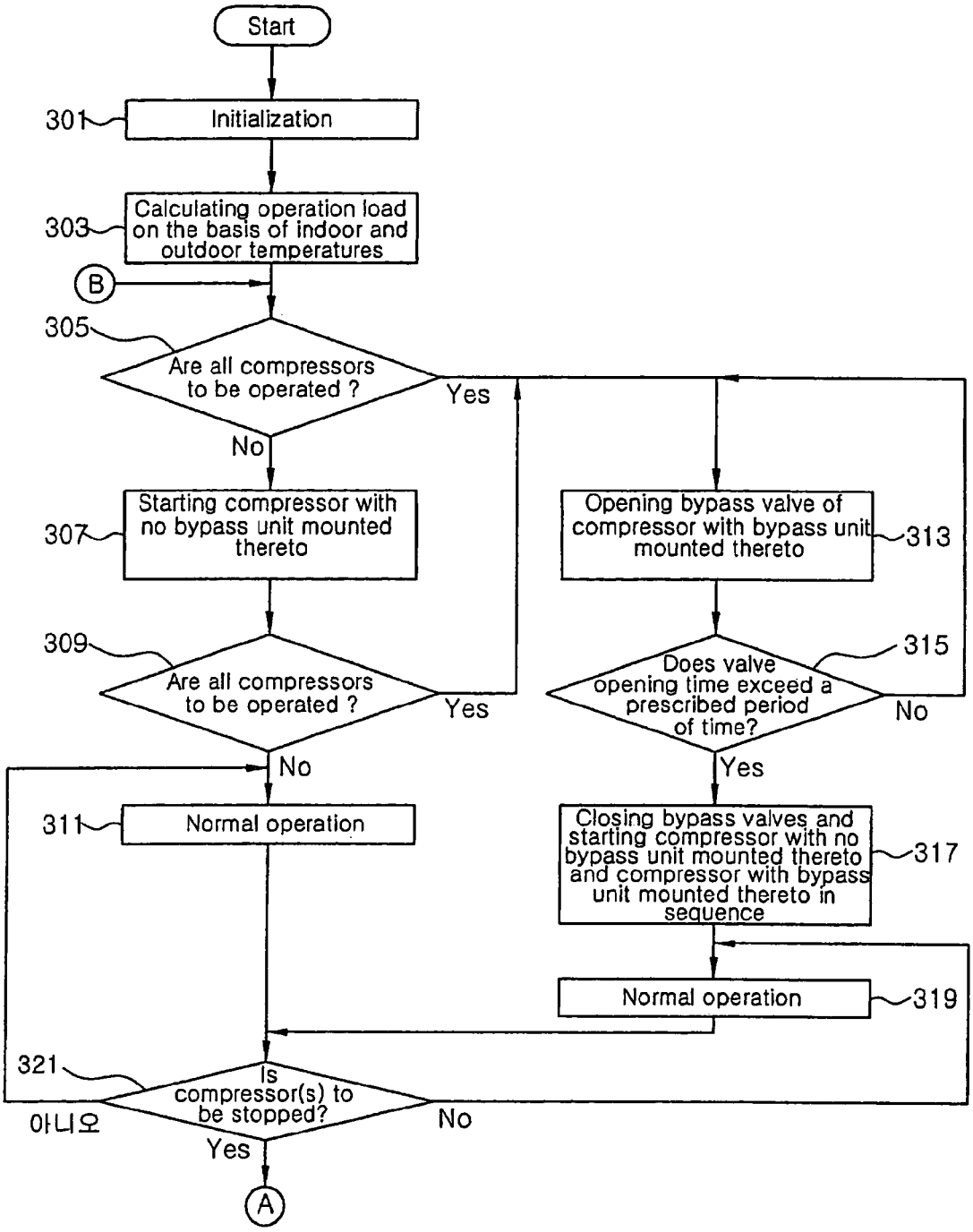
FIGS. 6*e* and 6*f* are flow charts showing a compressor controlling method according to a fourth embodiment of the present invention.
Figure 6F:
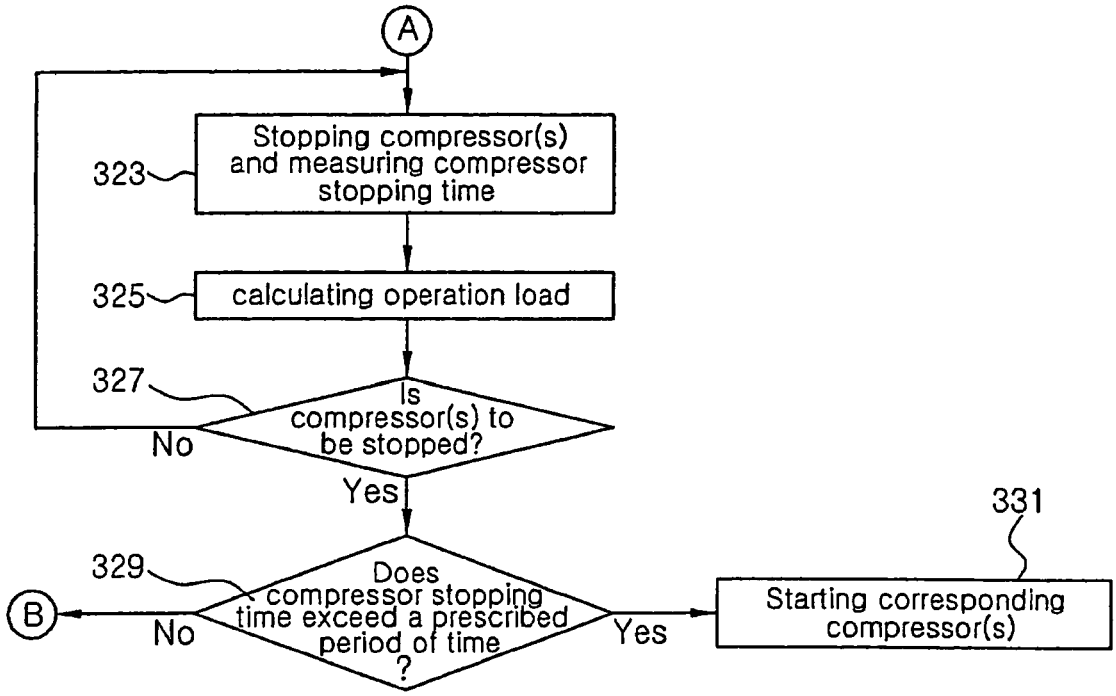

FIGS. 6*e* and 6*f* are flow charts showing a compressor controlling method according to a fourth embodiment of the present invention. The control unit 106 initializes the air conditioner, calculates an operational load on the basis of indoor and outdoor temperatures sensed by temperature sensors 101 and 103, and determines whether all the plural compressors are to be operated according to the calculated operational load (301, 303 and 305).

When not all the compressors are to be operated, the control unit 106 starts the compressor with no bypass unit mounted thereto (307). After the start-up of the compressor with no bypass unit mounted thereto is completed, the control unit 106 calculates an operational load again, and determines whether all the plural compressors are to be operated according to the calculated operational load (309). When not all the compressors are to be operated, the compressor is normally operated (311).

When all the compressors are to be operated 305 or 309, the control unit 106 opens the bypass valve of the compressor with the bypass unit mounted thereto (313), measures valve opening time by an inner timer, and determined whether the measured valve opening time exceeds a prescribed period of time (315). When the measured valve opening time exceeds a prescribed period of time, the control unit 106 closes the bypass valve, and starts the compressor with no bypass unit mounted thereto and the compressor with the bypass unit mounted thereto in sequence (317). Thereafter, the compressors are normally operated (319).

Whether the operation of the compressor(s) is to be stopped during the normal operation of the compressor(s) is then determined (321). When the operation of the compressor (s) is determined to be stopped, the control unit 106 stops the operation of the compressor(s), measures compressor stopping time by a timer T, and determines whether the stopped compressor(s) is to be started on the basis of the calculated operational load (323, 325 and 327). When the compressor(s) is determined to be started, the control unit 106 determines whether the measured compressor stopping time exceeds a prescribed period of time. When the measured compressor stopping time is determined to exceed the prescribed period of time, the procedure proceeds to operation 331 so that the corresponding compressor(s) may be started. When the measured compressor stopping time does not exceed the prescribed period of time, on the other hand, the control unit 106, the procedure is returned to operation 305 (329).

In the third and fourth embodiments of the present invention as described above, the compressor stopping time is measured to determine whether the pressure equilibrium is achieved, although starting the compressor(s) after the bypass valve(s) is opened constantly for a prescribed period of time without determining whether the pressure equilibrium is achieved may be possible. As will be described below, determining whether the pressure equilibrium is achieved by directly sensing the pressure difference using inlet and outlet pressure sensors of compressors is also possible.

Figure 7A:
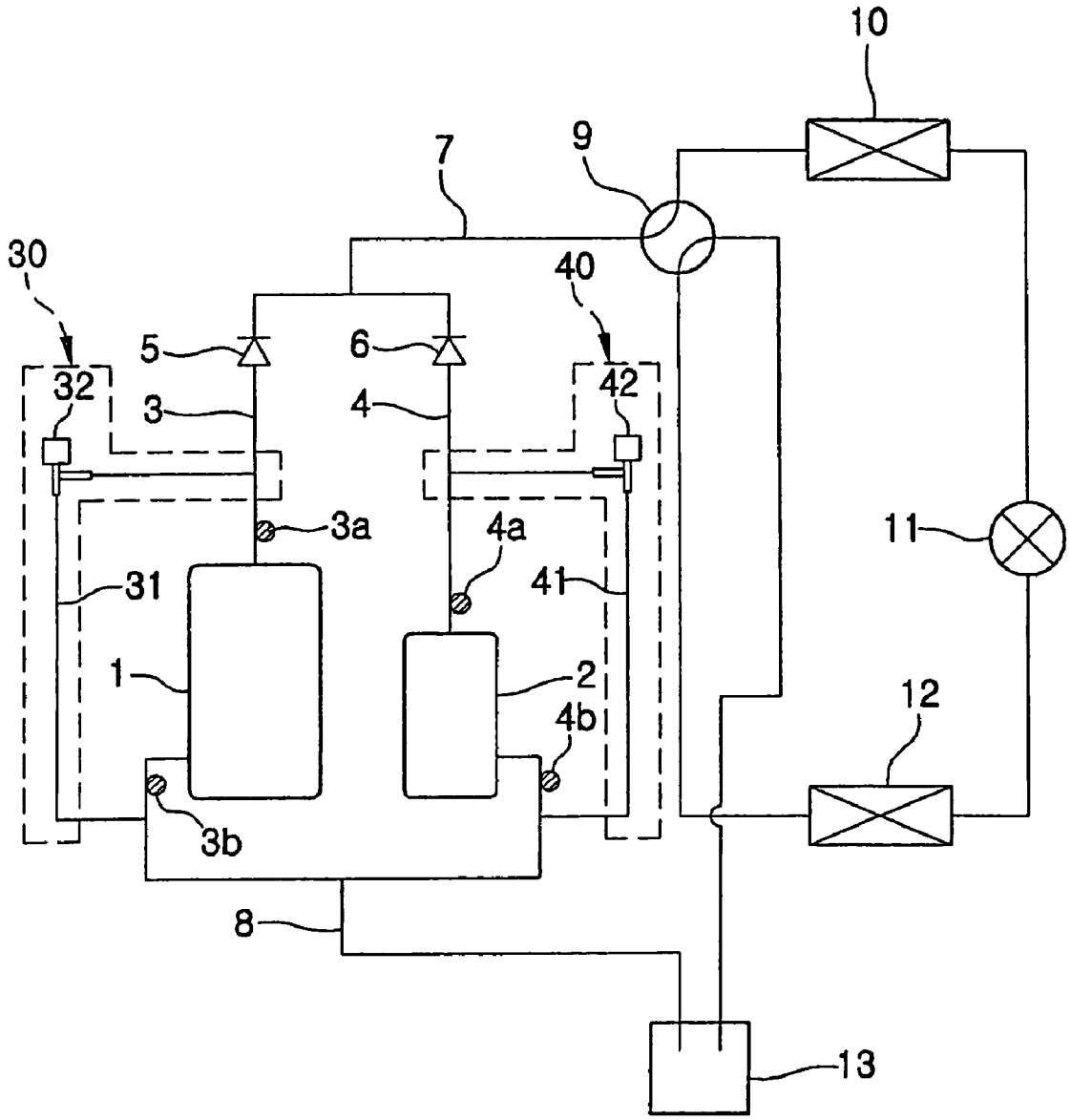
FIG. 7*a* is a view of a compressor controlling apparatus according to a fifth embodiment of the present invention showing bypass units and pressure sensors applied to plural compressors.

Bypass units and pressure sensors may be mounted to both of the plural compressors 1 and 2 so that a poor start-up of the compressors is prevented. FIG. 7*a* is a view of a compressor controlling apparatus according to a fifth embodiment of the present invention showing bypass units and pressure sensors applied to plural compressors. Here, a first bypass unit 30, a first outlet pressure sensor 3*a*, and a first inlet pressure sensor 3*b* are mounted to the large capacity compressors, which is one of the compressors. A second bypass unit 40, a second outlet pressure sensor 4*a*, and a second inlet pressure sensor 4*b* are mounted to the small capacity compressor, which is the other compressor.

Figure 7B:
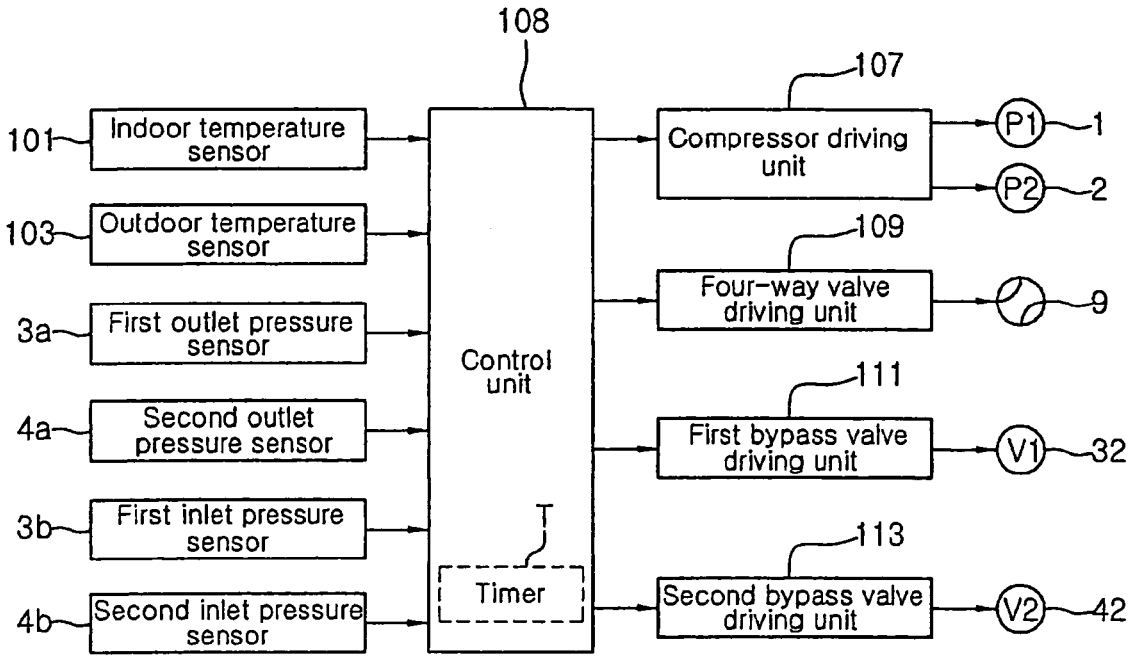
FIG. 7*b* is a control block diagram of FIG. 7*a*.

After a bypass valve(s) is opened, a control unit 108 determines whether the pressure difference between the outlet pressure and the inlet pressure of the compressor(s), which is sensed by the sensors, is below a prescribed value (See FIG. 7*b*). When the pressure difference is determined to be below the prescribed value, the control unit 108 closes the bypass valve(s), and starts the compressor(s).

Figure 7C:
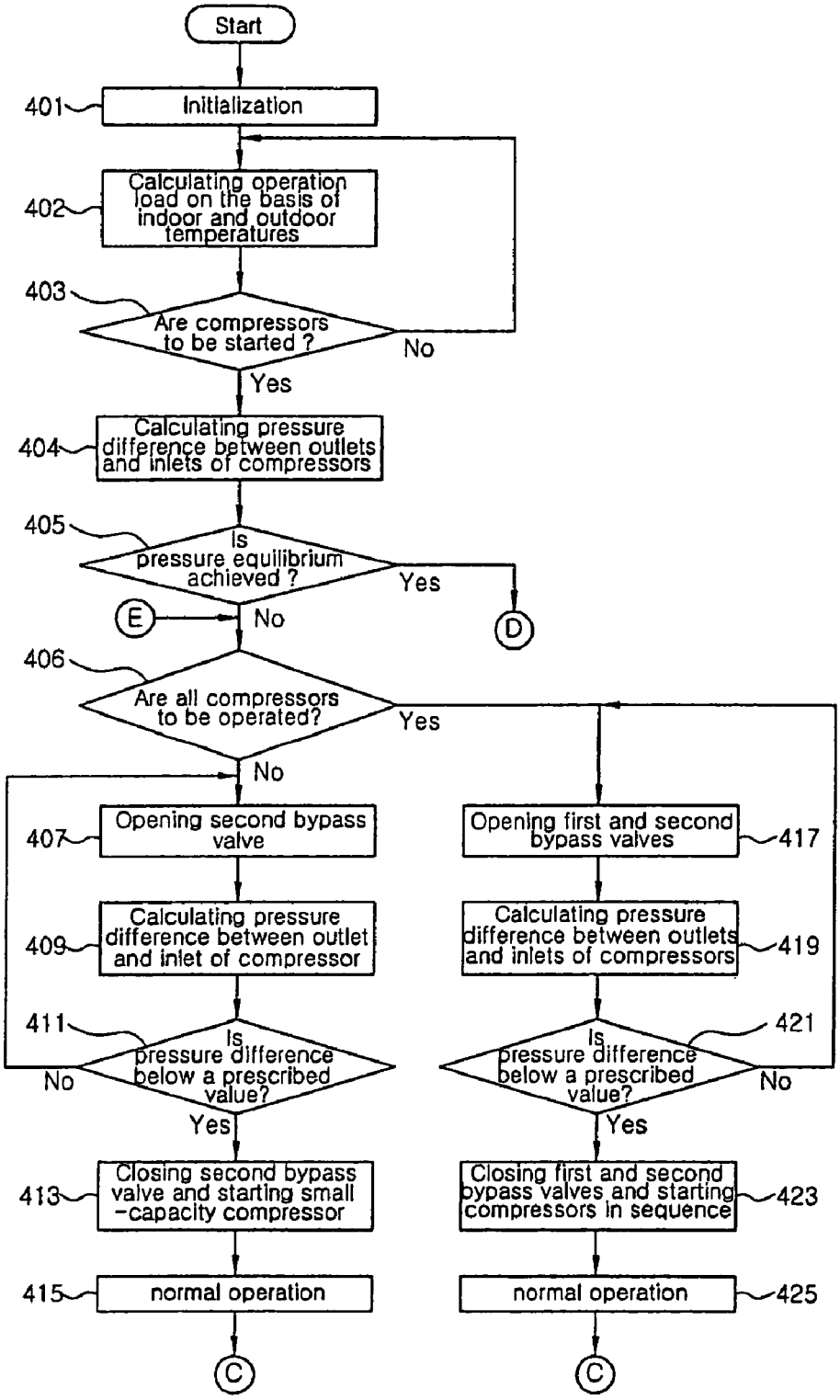
FIGS. 7*c* and 7*d* are flow charts showing a compressor controlling method according to a fifth preferred embodiment of the present invention.
Figure 7D:
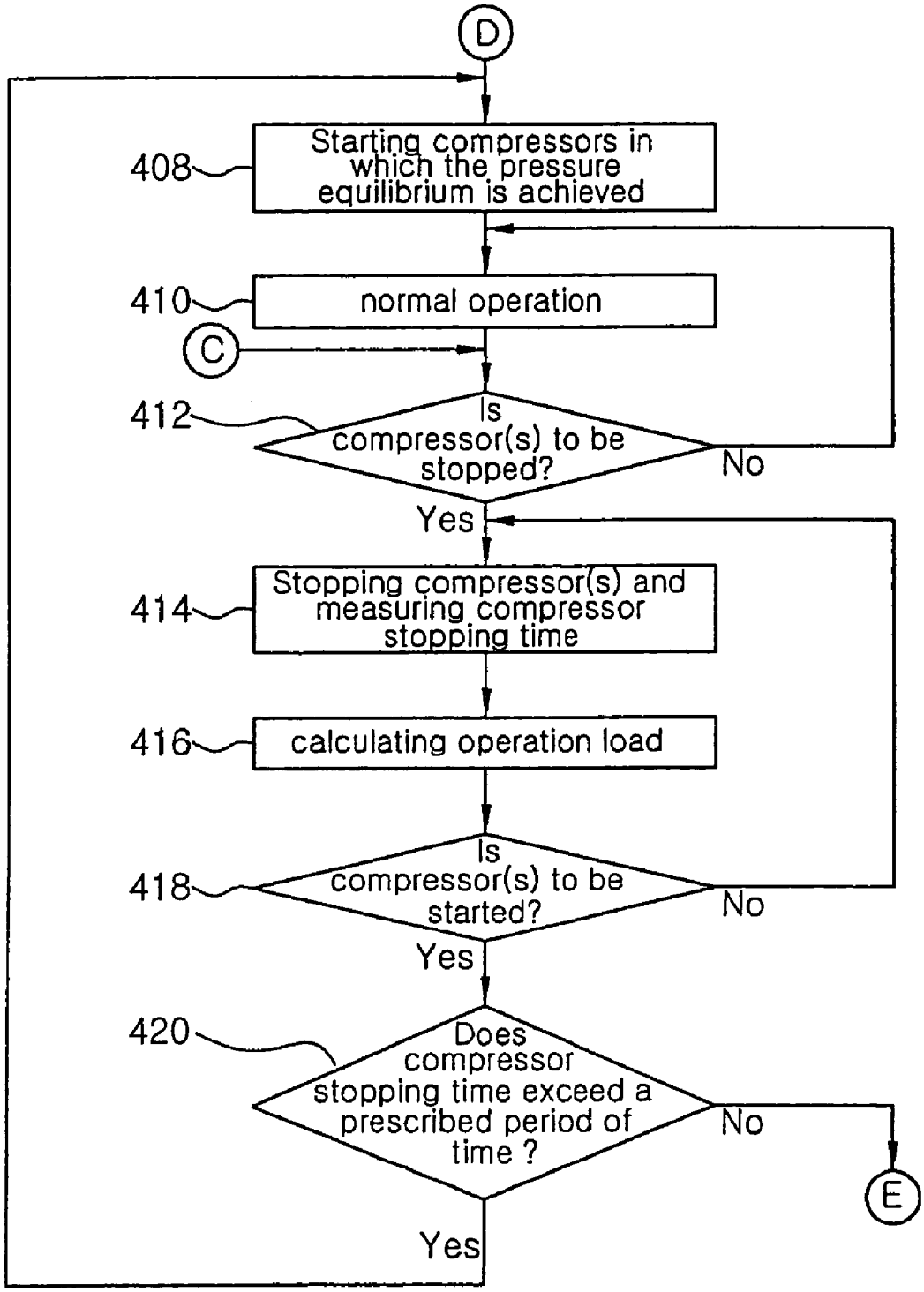

FIGS. 7*c* and 7*d* are flow charts showing a compressor controlling method according to a fifth embodiment of the present invention. The control unit 108 initializes the air conditioner, calculates operational load based on indoor and outdoor temperatures sensed by temperature sensors 101 and 103, and determines whether the compressors are to be operated according to the calculated operational load (401, 402 and 403). When the compressors are to be operated, the control unit 108 calculates the pressure difference between the outlets and the inlets of the compressors by the outlet pressure sensors 3*a* and 4*a* and the inlet pressure sensors 3*b* and 4*b*, and compares the pressure difference with a prescribed valve to determine whether pressure equilibrium is achieved (404 and 405).

When pressure equilibrium is not achieved, the control unit 108 determines whether all the compressors are to be operated based on the calculated operational load (406). When not all the compressors are to be operated, the control unit 108 opens a second bypass valve 42 mounted to the small-capacity compressor 2, calculates pressure difference between the outlets and the inlets of the compressors by the outlet pressure sensors 3*a* and 4*a* and the inlet pressure sensors 3*b* and 4*b*, and determines whether the calculated pressure difference is below the prescribed value, i.e., whether the pressure equilibrium is achieved (409 and 411). When the pressure difference is determined to be below the prescribed value, the control unit 108 closes the second bypass valve 42, and starts the small-capacity compressor (413). Thereafter, the compressor is normally operated (415).

When the compressors are to be operated, the control unit 108 opens a first bypass valve 32 mounted to the large-capacity compressor as well as the second bypass valve 42, calculates pressure difference between the outlets and the inlets of the compressors by the outlet pressure sensors 3*a* and 4*a* and the inlet pressure sensors 3*b* and 4*b*, and determines whether the calculated pressure difference is below the prescribed value, i.e., whether the pressure equilibrium is achieved (419 and 421). When the pressure difference is determined to be below the prescribed value, the control unit 108 closes the first and second bypass valves 32 and 42, and starts the compressors in sequence (423). Thereafter, the compressors are normally operated (425).

When the pressure equilibrium is achieved at operation 405, the control unit 108 starts the compressors in which the pressure equilibrium is achieved (408). Whether the operation of the compressors is to be stopped during the normal operation of the compressors (410 and 412) is then determined. When the operation of the compressors is to be stopped, the control unit 108 stops the operation of the compressors, measures compressor stopping time by a timer T, and determines whether the stopped compressors are to be started based on calculated operational load (414, 416 and 418). When the compressors are to be started, the control unit 108 determines whether the measured compressor stopping time exceeds a prescribed period of time. When the measured compressor stopping time exceeds the prescribed period of time, the procedure is returned to operation 408 (420). When the measured compressor stopping time does not exceed the prescribed period of time at operation 420, on the other hand, the procedure is returned to operation 406.

In the fifth embodiment of the present invention as described above, the compressor stopping time is measured to determine whether the pressure equilibrium is achieved, although starting the compressor(s) after the bypass valve(s) is opened constantly for a prescribed period of time without determining whether the pressure equilibrium is achieved may be possible. Determining whether the pressure equilibrium is achieved by directly sensing the pressure difference using inlet and outlet pressure sensors is also possible.

As is apparent from the above description, the present invention provides a compressor controlling apparatus and method that is capable of achieving pressure equilibrium between outlet pressure and inlet pressure of a non-operated compressor by a bypass unit provided between an inlet and an outlet of the compressor, and starting the non-operated compressor while the pressure equilibrium is achieved. Consequently, the present invention has the effect of preventing a poor start-up of the compressor, which is caused due to an excessive pressure difference, and improving reliability of the compressor.

According to the present invention, compressor stopping time is measured to determine whether the pressure equilibrium is achieved, or pressure difference is sensed by means of pressure sensors to determine whether the pressure equilibrium is achieved. Consequently, a bypass unit may achieve the pressure equilibrium accurately and quickly within a short period of time when the pressure equilibrium is not achieved.

Starting the compressor is started after the bypass valve is opened constantly for a prescribed period of time without determining whether the pressure equilibrium is achieved is also possible. Consequently, the compressor may be smoothly started without a pressure equilibrium determining unit.

According to the present invention, a compressor with no bypass unit mounted thereto is operated earlier than another compressor with a bypass unit mounted thereto so that the plural compressors may be smoothly started. Also, the bypass unit needs not be mounted to all the compressors. Consequently, the number of components of the compressor controlling apparatus is decreased, whereby manufacturing costs of the compressor controlling apparatus are reduced.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A compressor controlling apparatus, comprising:

a plurality of compressors, the plurality of compressors being all of the compressors controlled by the compressor controlling apparatus;

a plurality of bypass units corresponding to the compressors, each bypass unit directly connected between an outlet and an inlet of a respective one of the compressors, and including a bypass valve; and a control unit to reduce a pressure difference between the outlet and the inlet of each of the compressors via each corresponding bypass valve so as to start the compressors when the compressors are to be started.

2. The apparatus according to claim 1, wherein each of the bypass units comprises: a bypass line connected between the outlet and the inlet of the respective one of the compressors; and wherein the bypass valve is mounted on the bypass line.

3. The apparatus according to claim 2, wherein one end of the bypass line is disposed between the outlet of the one of the respective compressors and a reverse-flow preventing check valve.

4. The apparatus according to claim 1, wherein the bypass units are operated according to control of the control unit for more than the minimum time necessary to achieve pressure equilibrium between inlet and outlet pressures of the compressors.

5. A compressor controlling apparatus, comprising:

a plurality of compressors, the plurality of compressors being all of the compressors controlled by the compressor controlling apparatus;

a plurality of bypass units corresponding to the compressors, each bypass unit connected between an outlet and an inlet of a respective one of the compressors, and including a bypass valve;

a pressure equilibrium determining unit to determine whether a pressure equilibrium between the inlet and the outlet of each of the compressors is achieved; and a control unit to reduce a pressure difference between the outlet and the inlet of each of the compressors via each corresponding bypass valve to start the compressors if the pressure equilibrium determining unit determines that the pressure equilibrium is not achieved when the compressors are to be started.

6. The apparatus according to claim 5, wherein the pressure equilibrium determining unit includes sensors to sense the pressure difference between the outlet and the inlet of each of the compressors, and determines that the pressure equilibrium is not achieved if the pressure difference sensed by the sensors is above a prescribed value.

7. The apparatus according to claim 5, wherein the pressure equilibrium determining unit includes a timer to measure compressor stopping time, and determines that the pressure equilibrium is not achieved if the measured compressor stopping time is below a prescribed period of time.

8. The apparatus according to claim 5, wherein each of the bypass units comprises: a bypass line connected between the outlet and the inlet of the respective one of the compressors; and wherein the bypass valve is mounted on the bypass line.

9. The apparatus according to claim 8, wherein one end of the bypass line is disposed between the outlet of the respective one of the compressors and a reverse-flow preventing check valve.

10. A compressor controlling apparatus, comprising:

plural compressors connected to each other in parallel, the plural compressors being all of the compressors controlled by the compressor controlling apparatus;

a plurality of bypass units, each bypass unit being connected between an outlet and an inlet of a corresponding one of the compressors, and including a bypass valve; and a control unit to reduce a pressure difference between the outlet and the inlet of each non-operated one of the compressors via each corresponding bypass valve to start each of the non-operated ones of the compressors when each of the non-operated ones of the compressors is to be started.

11. The apparatus according to claim 10, wherein each of the bypass units comprises: a bypass line connected between the outlet and the inlet of the respective one of the compressors; and wherein the bypass valve is mounted on the bypass line.

12. The apparatus according to claim 11, wherein one end of the bypass line is disposed between the outlet of the respective one of the compressors and a reverse-flow preventing check valve.

13. The apparatus according to claim 10, wherein the bypass units are operated according to control of the control unit for more than the minimum time necessary to achieve a pressure equilibrium between inlet and outlet pressures of the compressors.

14. The apparatus according to claim 10, wherein the plural compressors comprise two or more compressors having different capacities.

15. A compressor controlling apparatus, comprising:

plural compressors connected to each other in parallel;

a bypass unit connected between an outlet and an inlet of at least one of the compressors, including a bypass valve;

a pressure equilibrium determining unit to determine whether a pressure equilibrium between the inlet and the outlet of the at least one of the compressors with the bypass unit mounted thereto is achieved; and a control unit to reduce a pressure difference between the outlet and the inlet of the at least one compressor via the bypass valve to start the at least one compressor if the pressure equilibrium determining unit determines that the pressure equilibrium is not achieved when the at least one compressor is to be started, wherein one of the plural compressors without a bypass unit mounted thereto is started earlier then the at least one compressor when the plural compressors are initially started.

16. The apparatus according to claim 15, wherein the pressure equilibrium determining unit includes sensors to sense the pressure difference between the outlet and the inlet of the compressor, and determines that the pressure equilibrium is not achieved if the pressure difference sensed by the sensors is above a prescribed value.

17. The apparatus according to claim 15, wherein the pressure equilibrium determining unit includes a timer to measure compressor stopping time, and determines that the pressure equilibrium is not achieved if the measured compressor stopping time is below a prescribed period of time.

18. The apparatus according to claim 15, wherein the plural compressors comprise two or more compressors having different capacities.

19. The apparatus according to claim 15, wherein the control unit starts the compressor with no bypass unit mounted thereto earlier than the compressor with the bypass unit mounted thereto when the plural compressors are initially started.

20. A compressor controlling method for a plurality of compressors, each compressor having a corresponding bypass unit directly connected between an outlet and an inlet of each compressor and a control unit, and including a bypass valve, wherein the method comprises:

determining whether each compressor is to be started;

reducing a pressure difference between the outlet and inlet of each compressor via the corresponding bypass valve to achieve a pressure equilibrium when each compressor is to be started; and starting each compressor while the pressure equilibrium is achieved, wherein the plurality of compressors are all of the compressors controlled by the compressor controlling method.

21. A compressor controlling method for a plurality of compressors, each compressor having a corresponding bypass unit directly connected between an outlet and an inlet of each compressor and including a bypass valve, a pressure equilibrium determining unit to determine whether pressure equilibrium between the inlet and the outlet of each compressor is achieved, and a control unit, wherein the method comprises:

determining whether each compressor is to be started;

determining whether the pressure equilibrium is achieved for each compressor via the pressure equilibrium determining unit when each compressor is to be started;

reducing a pressure difference between the outlet and inlet of each compressor via the corresponding bypass valve to achieve a pressure equilibrium when the pressure equilibrium between the inlet and the outlet of each compressor is not achieved; and starting each compressor while the pressure equilibrium is achieved, wherein the plurality of compressors are all of the compressors controlled by the compressor controlling apparatus.

22. A compressor controlling method for plural compressors having a bypass unit connected between an outlet and an inlet of at least one of the compressors which includes a bypass valve, and a control unit, wherein the method comprises:

determining whether the compressors are to be started;

initially starting the compressor without a bypass unit mounted thereto first when the compressors are to be started;

reducing a pressure difference between the outlet and inlet of the compressor with the bypass unit mounted thereto via the bypass valve to achieve a pressure equilibrium when the compressor with the bypass unit mounted thereto is to be initially started; and starting the compressor with the bypass unit mounted thereto while the pressure equilibrium is achieved.

* * * * *

UNITED STATES PATENT AND TRADEMARK OFFICE

CERTIFICATE OF CORRECTION

PATENT NO. : 7,665,318 B2
APPLICATION NO. : 11/094781
DATED : February 23, 2010
INVENTOR(S) : Gyoo Ha Jung et al.

It is certified that error appears in the above-identified patent and that said Letters Patent is hereby corrected as shown below:

On the Title Pg, Item (56), below "U.S. PATENT DOCUMENTS", under "4,324,105 A * 4/1982 Cann.....62/196.2" insert --4,484,452 * 11/1984 Houser.....62/174--.

Column 12, Line 57, change "then" to --than--.

Signed and Sealed this

First Day of June, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,665,318 B2
APPLICATION NO. : 11/094781
DATED : February 23, 2010
INVENTOR(S) : Jung et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 840 days.

Signed and Sealed this

Twenty-eighth Day of December, 2010

David J. Kappos

David J. Kappos
*Director of the United States Patent and Trademark Office*